US012178274B2

(12) United States Patent
Lombardi et al.

(10) Patent No.: US 12,178,274 B2
(45) Date of Patent: Dec. 31, 2024

(54) HARD HAT ACCESSORY BRACKET

(71) Applicant: Milwaukee Electric Tool Corporation, Brookfield, WI (US)

(72) Inventors: Samuel L. Lombardi, Milwaukee, WI (US); Todd Andrew Zeilinger, Wauwatosa, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 99 days.

(21) Appl. No.: 18/063,475

(22) Filed: Dec. 8, 2022

(65) Prior Publication Data

US 2023/0157398 A1 May 25, 2023

Related U.S. Application Data

(63) Continuation of application No. PCT/US2022/080265, filed on Nov. 21, 2022.

(60) Provisional application No. 63/295,065, filed on Dec. 30, 2021, provisional application No. 63/282,034, filed on Nov. 22, 2021.

(51) Int. Cl.
*A42B 3/04* (2006.01)

(52) U.S. Cl.
CPC ..... *A42B 3/0406* (2013.01)

(58) Field of Classification Search
CPC ..... A42B 3/0406; A42B 3/0426; A42B 3/044; A42B 3/0446; A42B 3/04
USPC ..... 2/422
See application file for complete search history.

(56) References Cited

U.S. PATENT DOCUMENTS

| | | | | |
|---|---|---|---|---|
| 4,002,895 | A * | 1/1977 | Ketler | F21L 14/026 362/106 |
| 4,521,831 | A | 6/1985 | Thayer | |
| 4,793,007 | A | 12/1988 | Barnett | |
| 6,497,493 | B1 | 12/2002 | Theisen | |
| 9,578,916 | B2 | 2/2017 | Daniels et al. | |
| 9,872,531 | B2 * | 1/2018 | Uke | A42B 3/04 |
| 9,885,471 | B2 | 2/2018 | Dirsa et al. | |
| 10,645,987 | B2 | 5/2020 | Maldonado et al. | |
| 10,743,599 | B2 | 8/2020 | Silva et al. | |
| 10,912,344 | B2 | 2/2021 | Bohn et al. | |
| 11,019,870 | B2 | 6/2021 | Hyma | |
| 11,213,087 | B2 | 1/2022 | Hyma | |
| 2009/0038056 | A1 | 2/2009 | Bobbin et al. | |
| 2015/0323779 | A1 | 11/2015 | Teetzel et al. | |

(Continued)

FOREIGN PATENT DOCUMENTS

| | | |
|---|---|---|
| CN | 206724092 | 12/2017 |
| CN | 108730931 | 11/2018 |
| WO | WO12006653 | 1/2012 |

OTHER PUBLICATIONS

International Search Report and Written Opinion for International Application No. PCT/US2022/080265, dated Mar. 31, 2023, 11 pages.

*Primary Examiner* — Timothy K Trieu
(74) *Attorney, Agent, or Firm* — Reinhart Boerner Van Deuren s.c.

(57) ABSTRACT

Various embodiments of an accessory bracket for attaching accessories to protective equipment are shown. The accessory bracket includes a mounting bracket body, a center tab, and one or more cam levers that allow for secure attachment to protective equipment. The accessory bracket is designed to improve attachment and retention of accessories to protective equipment.

20 Claims, 27 Drawing Sheets

(56) References Cited

U.S. PATENT DOCUMENTS

| | | | | |
|---|---|---|---|---|
| 2017/0049176 | A1 | 2/2017 | Bernier et al. | |
| 2017/0127745 | A1 | 5/2017 | Daniels et al. | |
| 2017/0231311 | A1 | 8/2017 | Chen et al. | |
| 2018/0220729 | A1 | 8/2018 | Soto et al. | |
| 2019/0082765 | A1 | 3/2019 | Manning et al. | |
| 2019/0231016 | A1 | 8/2019 | Deshpande et al. | |
| 2019/0350291 | A1 | 11/2019 | Maldonado et al. | |
| 2020/0154811 | A1* | 5/2020 | Hyma | A42B 3/042 |
| 2020/0225488 | A1 | 7/2020 | Goupil et al. | |
| 2020/0288806 | A1 | 9/2020 | Vilone et al. | |
| 2020/0329806 | A1* | 10/2020 | Wong | H01M 50/10 |
| 2021/0145104 | A1 | 5/2021 | Jones et al. | |
| 2022/0015488 | A1 | 1/2022 | Adams et al. | |
| 2022/0047030 | A1 | 2/2022 | Summersett et al. | |
| 2022/0047033 | A1 | 2/2022 | Zeilinger et al. | |
| 2022/0175072 | A1 | 6/2022 | Jones et al. | |
| 2022/0248797 | A1 | 8/2022 | Zeilinger et al. | |
| 2022/0287403 | A1 | 9/2022 | Summersett et al. | |
| 2022/0295934 | A1 | 9/2022 | Adams et al. | |

* cited by examiner

HARD HAT ACCESSORY BRACKET

CROSS-REFERENCE TO RELATED PATENT APPLICATIONS

The present application is a continuation of International Application No. PCT/US2022/080265, filed Nov. 21, 2022, which claims benefit of and priority to U.S. Provisional Application No. 63/295,065, filed Dec. 30, 2021, and to U.S. Provisional Application No. 63/282,034, filed Nov. 22, 2021, which are incorporated herein by reference in their entireties.

BACKGROUND OF THE INVENTION

The present disclosure is directed generally to the field of protective equipment. The present disclosure relates specifically to hard hats and brackets for attaching accessories to protective equipment, such as a hard hat.

SUMMARY OF THE INVENTION

One embodiment of the invention relates to a hard hat system including a hard hat and a mounting bracket. The hard hat includes a mounting ridge extending outward from a surface of the hard hat. The mounting ridge includes opposing edges and a retention cleat positioned between the opposing edge. The mounting bracket securely and removably couples the mounting bracket to the mounting ridge of the hard hat. The mounting bracket includes a first end, a second end opposite the first end, a first slot located at the first end, the first slot receives and encloses one of the opposing edges of the mounting ridge, and a second slot located at the second end, the second slot receives and encloses the other of the opposing edges of the mounting ridge. The mounting bracket further includes a tab positioned between first end and the second end and configured to engage the retention cleat of the hard hat, a first lever coupled to the first end and a second lever coupled to the second end. When the first lever and the second lever are rotated, the mounting bracket clamps onto the opposing edges of the mounting ridge to couple the mounting bracket to the mounting ridge.

Another embodiment of the invention relates to a mounting bracket configured to coupled to a hard hat mounting ridge. The mounting bracket includes a first end, a second end opposite the first end, a first receiving slot that receives the mounting ridge and removably couples the mounting bracket to the hard hat, and a second receiving slot that receives the mounting ridge and removably couples the mounting bracket to the hard hat. The mounting bracket further includes a first rear clamp that at least partially defines the first receiving slot, a second rear clamp that at least partially defines the second receiving slot, a first cam lever, and a second cam lever, and a second cam lever. The first cam lever is positioned at the first end and is rotatably coupled to the mounting bracket. The second cam lever is positioned at the second end and is rotatably coupled to the mounting bracket. When a user actuates the first and second cam levers in a first direction, the first and second rear clamps are pulled toward the mounting bracket such that the mounting bracket compresses a portion of the mounting ridge. When the user actuates the first and second cam levers in a second direction, the first and second rear clamps are moved away from the mounting bracket such that the mounting bracket releases the portion of the mounting ridge.

Another embodiment of the invention relates to a hard hat accessory system including a hard hat and a mounting bracket. The hard hat includes a front mounting ridge on a front side surface, a rear mounting ridge on a rear side surface, and a detent positioned on at least one of the front mounting ridge and rear mounting ridge. The mounting bracket securely and removably mounts to either the front mounting ridge or the rear mounting ridge of the hard hat. The mounting bracket includes rear clamps, slots defining a distance between a rear surface of the mounting bracket and an inner surface of the rear clamps, the slots receive the mounting ridge and removably couple the mounting bracket to one of the front side surface of the rear side surface of the hard hat. The mounting bracket further includes cam levers rotatably coupled to the mounting bracket and a tab positioned between the cam levers and configured to engage the detent of the hard hat. When the cam levers are actuated, the distance between the rear surface of the mounting bracket and the inner surface of the rear clamps is changed.

Another embodiment of the invention relates to an accessory bracket for a hard hat. The hard hat includes a mounting ridge with opposing dovetail projections and a retention cleat. The accessory bracket securely and removably mounts on the mounting ridge of the hard hat. The accessory bracket includes a mounting bracket body coupled to an accessory at a front connection portion. The accessory bracket further includes a center tab, a pair of cam levers, and a pair of rear clamps. The center tab extends downward from the mounting bracket body and is positioned below the connection portion. The pair of cam levers are rotatably coupled to the mounting bracket and rotatable about an axial or minor axis of the cam levers. When an operator actuates the pair of cam levers in a first direction the rear clamps are pulled toward mounting bracket body such that the rear clamps and mounting bracket body together act to clamp or compress the dovetail projections of the hard hat. When an operator actuates the pair of cam levers in a second direction the rear clamps are moved away from the mounting bracket body such that the rear clamps and mounting bracket body release the dovetail projections of the hard hat.

Another embodiment of the invention relates to an accessory bracket for a hard hat. The hard hat includes a mounting ridge with opposing dovetail projections and a retention cleat. The accessory bracket securely and removably mounts on the mounting ridge of the hard hat. The accessory bracket includes a mounting bracket body coupled to an accessory at a front connection portion of mounting bracket body. The accessory bracket further includes a center tab, a pair of cam levers rotatably, and a pair of rear clamps. The center tab extends downward from the mounting bracket body and is positioned below the connection portion. The pair of cam levers are rotatably coupled to the mounting bracket and each cam lever is rotatable about a longitudinal axis of the respective cam lever. When an operator actuates the pair of cam levers in a first direction, the rear clamps are pulled toward mounting bracket body such that the rear clamps and mounting bracket body together act to clamp or compress the dovetail projections of the hard hat. When an operator actuates the pair of cam levers in a second direction, the rear clamps are moved away from the mounting bracket body such that the rear clamps and mounting bracket body release the dovetail projections of the hard hat.

Additional features and advantages will be set forth in the detailed description which follows, and, in part, will be readily apparent to those skilled in the art from the description or recognized by practicing the embodiments as described in the written description included, as well as the appended drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of accessory brackets are shown. Various embodiments of the accessory brackets discussed herein, are configured to attach to a mounting ridge or location (e.g., front, rear, side) on a hard hat and configured to provide for improved and secure coupling of an accessory. In contrast to the accessory brackets discussed herein, conventional accessory brackets may only be suitable for use with lighter weight accessories because the brackets rely on an interference fit between the mounting location and the bracket. In such typical bracket designs, when used to support a heavier accessory, Applicant has determined that the attachment between the mounting location and accessory bracket may allow the accessory bracket to fall off of the mounting location.

In particular the accessory brackets discussed herein are configured to provide secure attachment and retention to hard hats, especially for relatively heavy accessories (e.g., headlamps, batteries, safety sensors) even during an impact (e.g., forceful contact from falling objects, dropping of hard hat, etc.). In various embodiments, the accessory bracket may be configured to couple to accessories such as vital monitoring sensors that monitor the health and safety of the operator (e.g., temperature of operator, methane sensor, etc.). In various embodiments, the accessory brackets include a three-point locking system that is configured to provide the robust, high weight supporting connection discussed herein. The three-point locking system includes a center tab configured to grip onto a retention cleat positioned on the mounting location of the hard hat and a pair of locking features or cam levers that allow the accessory bracket to lock (e.g., clamp like a vise) onto dovetail projections positioned on each side of the mounting location. In a specific embodiment, the cam lever locking feature includes a horizontal disk cam lever. In another embodiment, the cam lever locking feature includes a vertical axis cam lever.

Figure 1:
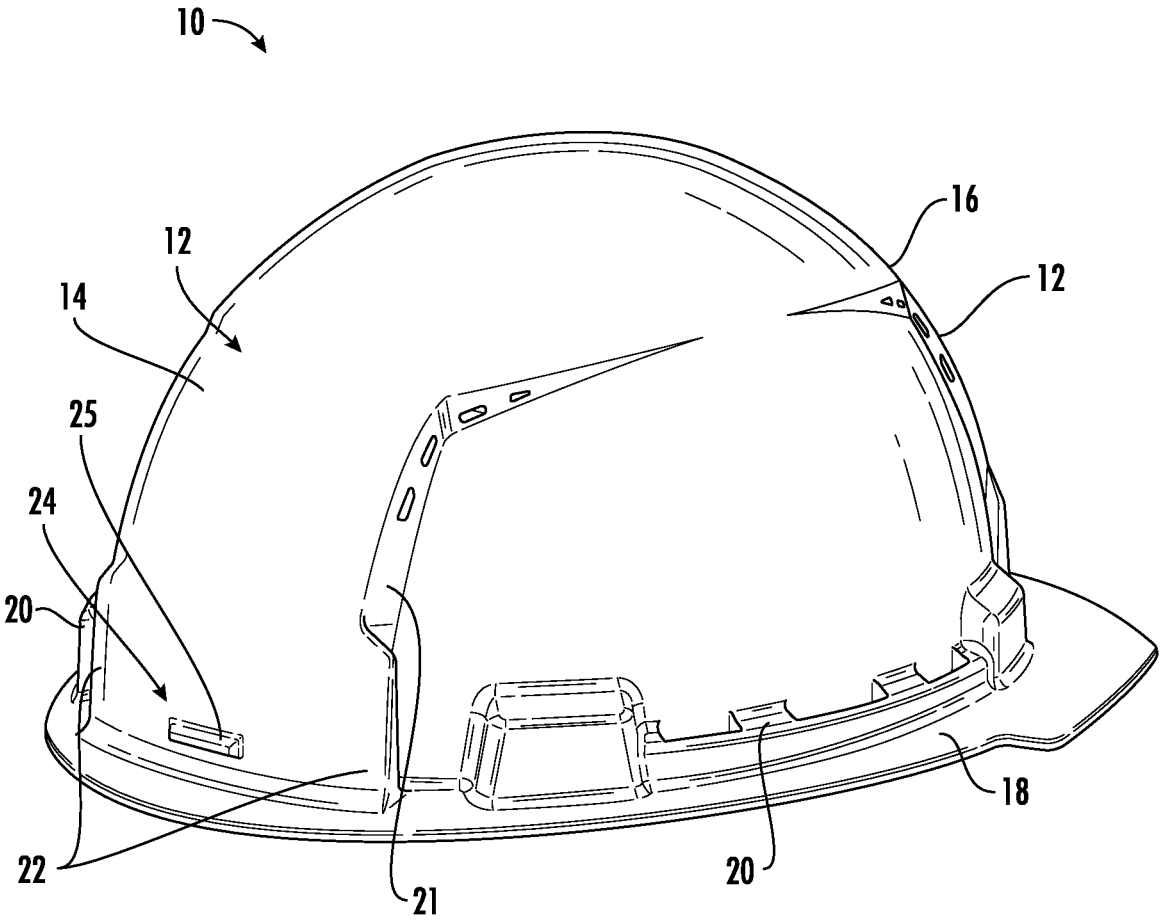
FIG. 1 is a perspective view of a hard hat, according to an exemplary embodiment.

Referring to FIG. 1, a perspective view of a hard hat 10 is shown according to an exemplary embodiment. A rear side surface 14 includes a mounting ridge 12. Similarly, a front side surface 16 that opposes rear side surface 14 includes mounting ridge 12. A bill or brim portion 18 extends outward from a lower circumference of hard hat 10 around at least part of hard hat 10. An opposing pair of side accessory ridges 20 are positioned between the mounting ridge 12 on front side surface 16 and the mounting ridge 12 on rear side surface 14. Each mounting ridge 12 includes a pair of dovetail projections or wings 22 extending outward from opposing planar surfaces 21 positioned on each side of mounting ridge 12. Each mounting ridge 12 further includes a retention cleat or detent 24 positioned between dovetail projections 22. In a specific embodiment, retention cleat 24 is centered on mounting ridge 12 between opposing dovetail projections 22. Retention cleat 24 includes an outer surface 25. Retention cleat 24 is positioned on at least one of the front mounting ridge 12 and rear mounting ridge 12.

Figure 2:
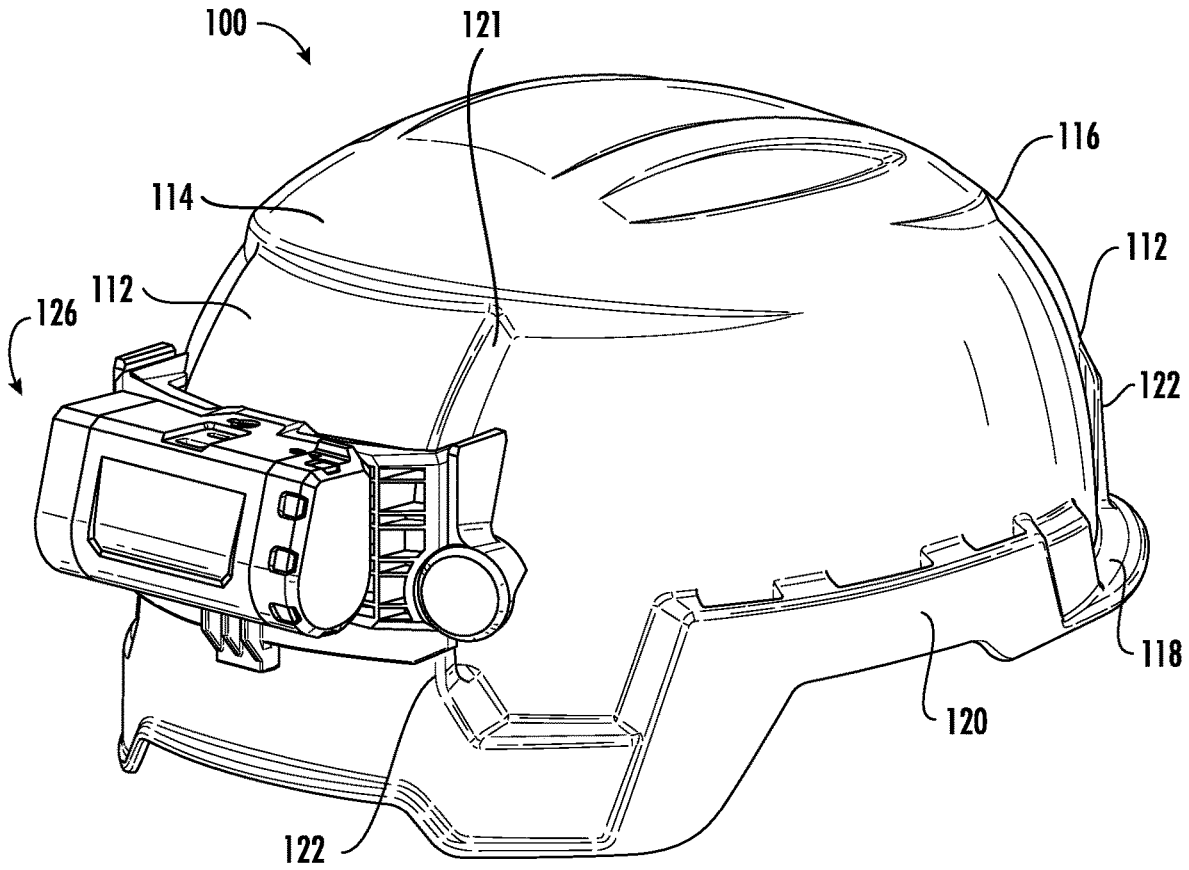
FIG. 2 is a perspective view of a hard hat connected to an accessory bracket at a rear mounting location of the hard hat, according to an exemplary embodiment.

Referring to FIG. 2, a perspective view of a hard hat 100 connected to mounting bracket, shown as an accessory bracket 126 which is shown according to an exemplary embodiment. Hard hat 100 is substantially the same as hard hat 10 except for the differences discussed herein. Accessory bracket 126 can be utilized with hard hat 10 or 100. A rear side surface 114 includes a mounting ridge 112. A front side surface 116 that opposes rear side surface 114 includes mounting ridge 112. A bill or brim portion 118 extends outward from a lower circumference of hard hat 100. Brim 118 is positioned at least partially below the mounting ridge 112 positioned on front side surface 116. An opposing pair of side accessory ridges 120 are positioned between the mounting ridge 112 on front side surface 116 and the mounting ridge 112 on rear side surface 114. Each mounting ridge 112 includes opposing edges shown as a pair of dovetail projections or wings 122 extending outward from opposing planar surfaces 121 positioned on each side of mounting ridge 112.

As shown, accessory bracket 126 is coupled to hard hat 100 and specifically to dovetail projections 122 of mounting ridge 112 located on rear side surface 114 of hard hat 100. Accessory bracket 126 can also be coupled to the mounting ridge 112 positioned on front side surface 116 of hard hat 100. Accessory bracket 126 securely and removably mounts to either the front mounting ridge 112 or rear mounting ridge 12 of the hard hat 100. Accessory bracket 126 includes a first end and a second end opposite the first end.

Figure 3:
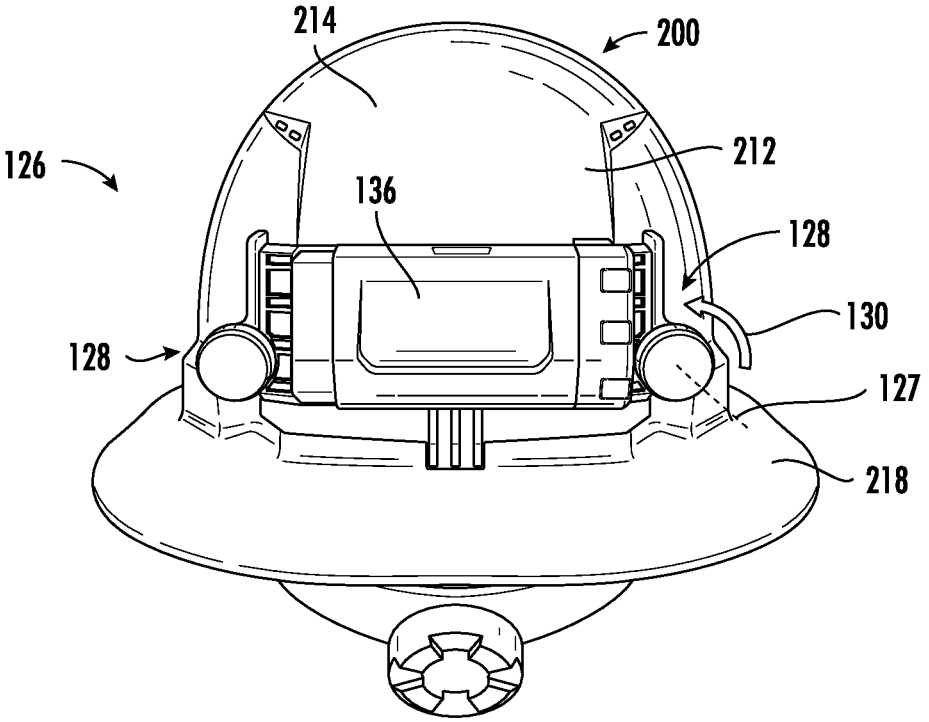
FIG. 3 is a perspective view of a hard hat connected to the accessory bracket of FIG. 2, with the accessory bracket shown in a first, locked position, according to an exemplary embodiment.

Referring to FIG. 3, a perspective view of a hard hat 200 connected to accessory bracket 126 which is in a first, locked position is shown according to an exemplary embodiment. Hard hat 200 is substantially the same as hard hats 10 and 100 except for the differences discussed herein. A rear side surface 214 includes a mounting ridge 212. A bill or brim portion 218 extends outward from a lower circumference of hard hat 200 around all of hard hat 200 (e.g., is a full brim hard hard). A portion of brim 218 is positioned below mounting ridge 212 positioned on rear side surface 214. Accessory bracket 126 includes one or more cam levers 128 configured to lock or secure accessory bracket 126 onto mounting ridge 212 and specifically to the dovetail projections (see e.g., 22 of FIG. 1 and 122 of FIG. 2) of hard hat 200.

In a specific embodiment, accessory bracket 126 includes a pair of cam levers 128. In such an embodiment, a first cam lever 128 is positioned at a first end of the accessory bracket 126 and rotatably coupled to accessory bracket 126. Similarly, second cam lever 128 is positioned at the second end of the accessory bracket 126 and rotatably coupled to accessory bracket 126. When cam levers 128 are in a locked position, each lever portion 131 (see e.g., 131 in FIG. 5) extends the opposing end projections 135 (i.e., in a generally parallel orientation to opposing planar surfaces 121 of mounting ridge 112. The first cam lever 128 is rotatable about a first axis of rotation 127 and the second cam lever 128 is rotatable about a second axis of rotation 127. The first and second axes of rotation 127 extend outward and forward from the accessory bracket 126 (see e.g., orientation in FIG. 6).

When an operator actuates cam levers 128 in the first, locking direction shown by arrow 130, cam levers 128 are rotated about an axis of rotation 127. Axis of rotation 127 extends in a perpendicular orientation to a longitudinal axis of cam lever 128. When cam levers 128 are in a locked position, accessory bracket 126 clamps or compresses onto the dovetail projections (see e.g., 22 of FIG. 1) of hard hat 200 to securely couple accessory bracket 126 to the mounting ridge 212 of the hard hat 200.

Figure 4:
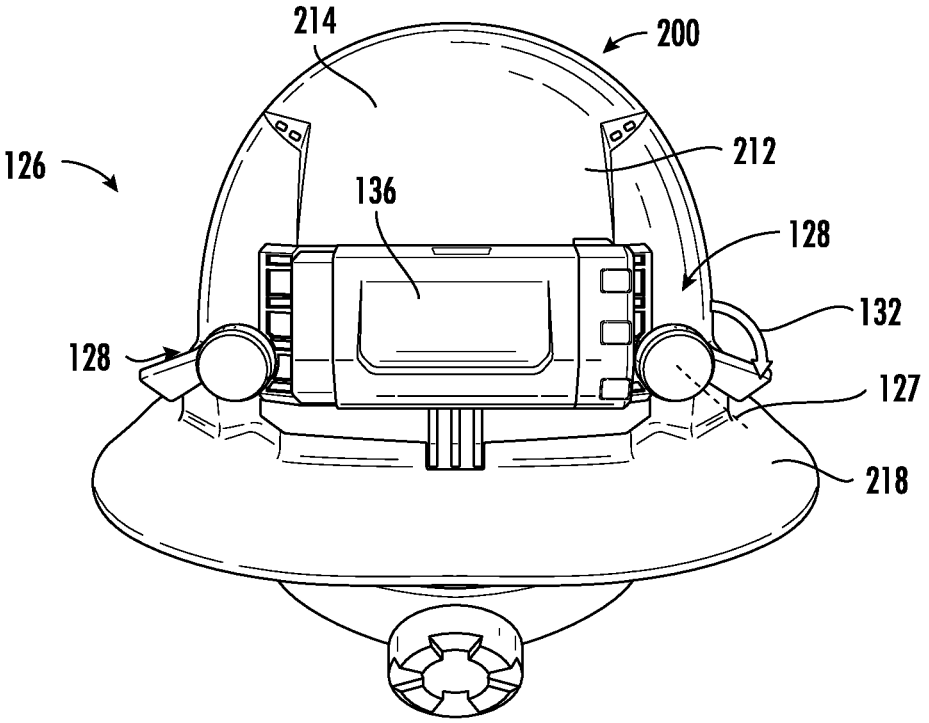
FIG. 4 is a perspective view of a hard hat connected to the accessory bracket of FIG. 2, with the accessory bracket shown in a second, unlocked position, according to an exemplary embodiment.

Referring to FIG. 4, a perspective view of a hard hat 200 connected to accessory bracket 126 which is in a second, unlocked position is shown according to an exemplary embodiment. When the operator actuates cam levers 128 in the second, unlocking direction shown by arrow 132, cam levers 128 are rotated about axis of rotation 127. When cam levers 128 are in the unlocked position, accessory bracket 126 unclamps and no longer compresses the dovetail projections (see e.g., 22 of FIG. 1) of hard hat 200 to securely couple accessory bracket 126 to the mounting ridge 212 of the hard hat 200. When cam levers 128 are in an unlocked position, each lever portion 131 (see e.g., 131 in FIG. 5) extends in a direction away from the opposing planar surfaces 121 positioned on each side of mounting ridge 112.

Figure 5:
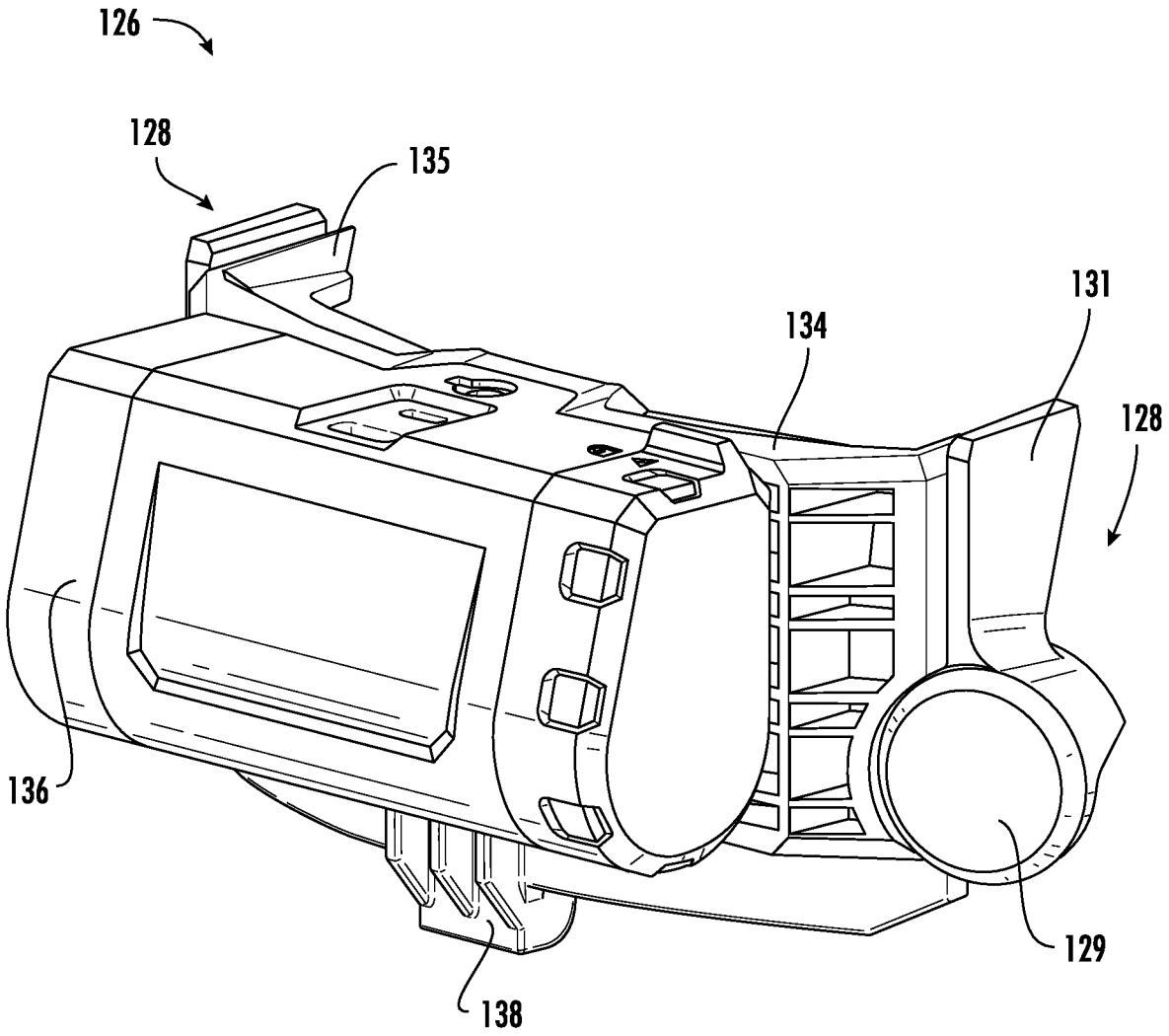
FIG. 5 is a perspective view of the accessory bracket of FIG. 2, according to an exemplary embodiment.

Referring to FIG. 5, a perspective view of accessory bracket 126 is shown according to an exemplary embodiment. Accessory bracket 126 includes a mounting bracket body 134 coupled to an accessory, shown as a battery pack 136 at a front connection portion 140 (see e.g., FIG. 6) of mounting bracket body 134. In other words, battery pack 136 is coupled to connection portion 140 of accessory bracket 126. When accessory bracket 126 is coupled to a hard hat, connection portion 140 faces away from the mounting ridge 112 and is positioned and/or extends between cam levers 128. Accessory bracket 126 further includes a tab, shown as a center tab 138 extending downward from the mounting bracket body 134 toward the brim of a hard hat. Center tab 138 is configured to grip, hold and/or engage a retention cleat or detent (see e.g., 24 of FIG. 1) of the hard hat (e.g., 10, 100, 200). The center tab 138 is positioned between cam levers 128.

Accessory bracket 126 further includes opposing end projections 135 positioned at the first and second ends of accessory bracket 126. Each end projection 135 extends backward (e.g., direction away from battery pack 136) from the mounting bracket body 134 on opposing sides of the front connection portion 140. Each end projection 135 includes opposing generally vertical edges. A horizontal or width axis of accessory bracket 126 extends between the first and second ends and specifically between opposing end projections 135. A height axis of accessory bracket 126 is perpendicular to the width axis. Axes of rotation 127 are perpendicular to both the height and width axis of accessory ridge 126.

A cam lever 128 is positioned against each end projection 135. Each cam lever 128 includes a body portion 129 and a lever portion 131. Lever portion 131 extends away from body portion 129 along a longitudinal axis of cam levers 128. In a specific embodiment, the body portion 129 has a partially cylindrical shape. Axis of rotation 127 extends through body portion 129 of cam lever 128. In a specific embodiment, body portion 129 is centered about axis of rotation 127.

Figure 6:
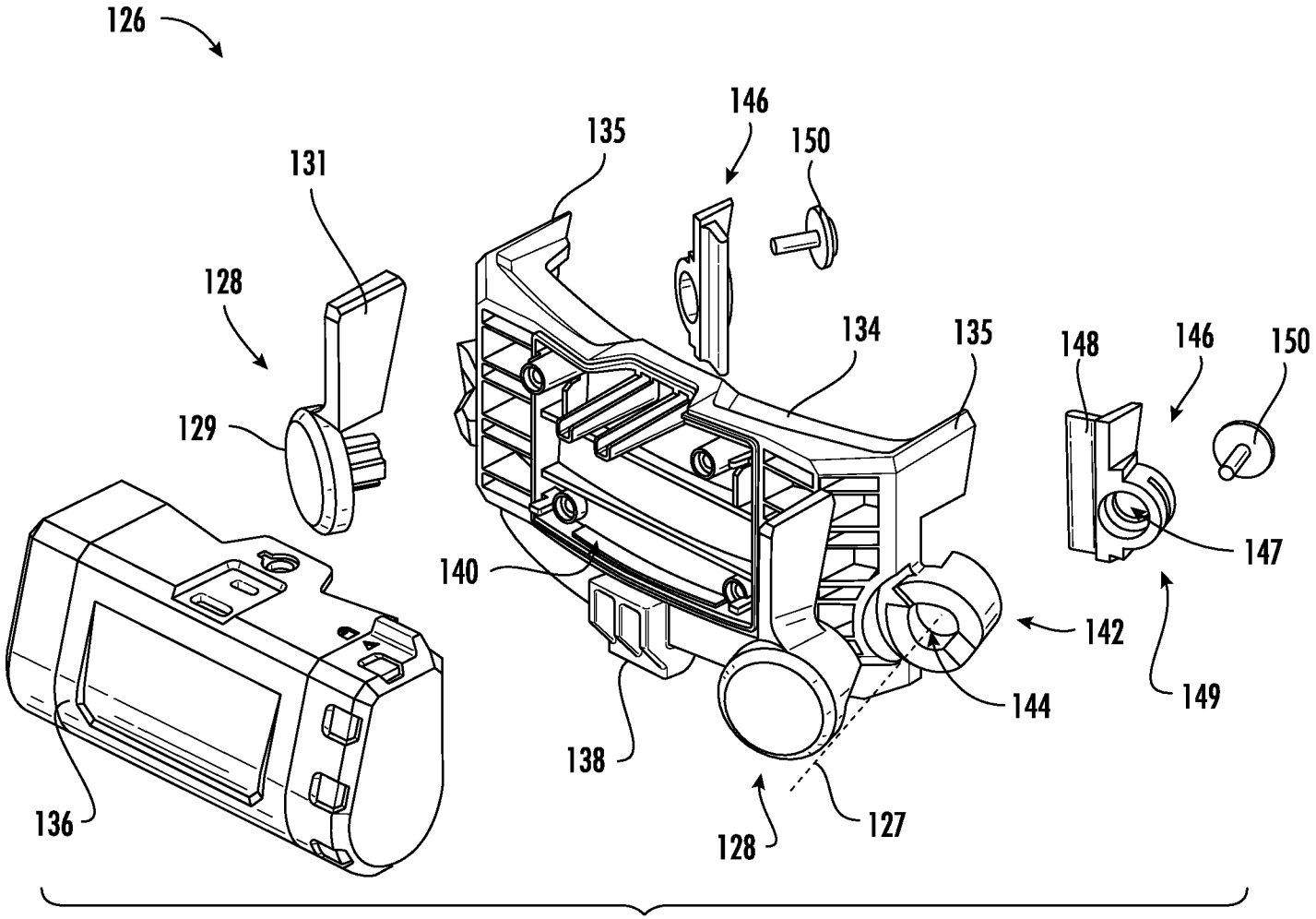
FIG. 6 is an exploded view of the accessory bracket of FIG. 2, according to an exemplary embodiment.

Referring to FIG. 6, an exploded view of the accessory bracket 126 is shown according to an exemplary embodiment. Mounting bracket body 134 further includes a pair of locking portions 142 on opposing sides of the front connection portion 140 and below the opposing end projections 135. Cam levers 128 are rotatably coupled to accessory bracket 126 and specifically to locking portions 142. Locking portions 142 have a shape corresponding to cam levers 128. Each locking portion 142 includes a bore 144 extending through the locking portion 142 along axis of rotation 127.

Accessory bracket 126 includes a pair of rear clamps 146. Each rear clamp 146 includes a clamping portion 148 and a clamp locking portion 149. Each clamp locking portion 149 includes a bore 147 extending through the clamp locking portion 149 along axis of rotation 127. A connector, shown as a screw 150 extends through bore 147 of each clamp locking portion 149 and bore 144 of the mounting bracket body 134 along axis of rotation 127 when accessory bracket 126 is assembled.

Figure 7:
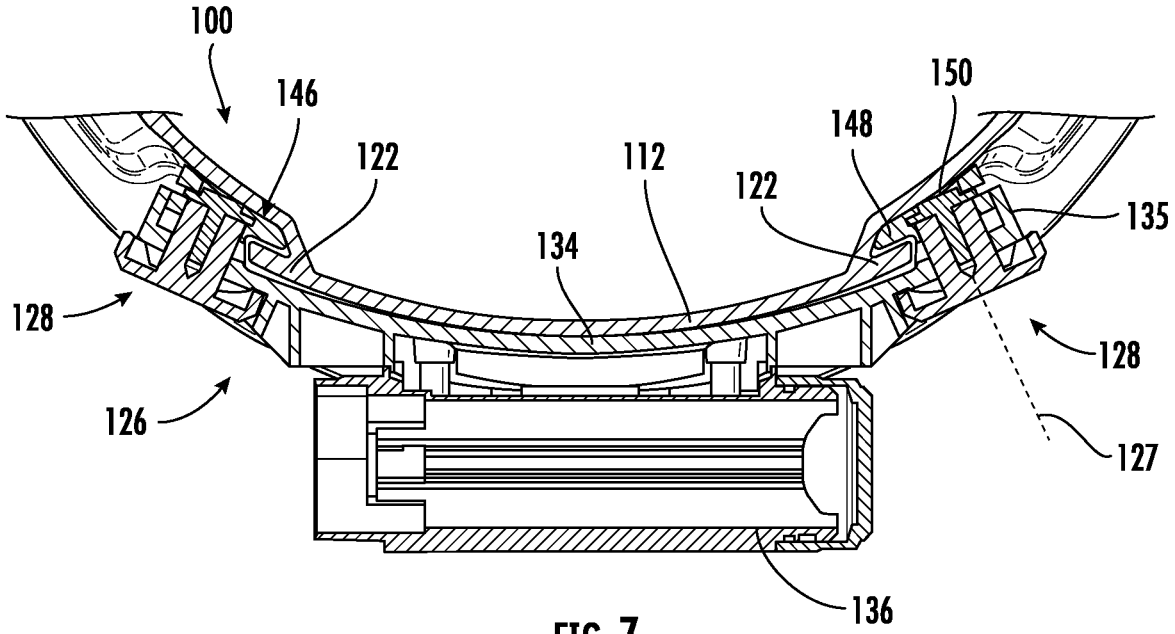
FIG. 7 is a cross-sectional view of the accessory bracket of FIG. 2, according to an exemplary embodiment.

Referring to FIG. 7, a cross-sectional view of the accessory bracket 126 coupled to hard hat 100 is shown according to an exemplary embodiment. As shown in FIG. 7, when accessory bracket 126 is connected to mounting ridge 112, clamping portion 148 of rear clamp 146 and mounting bracket body 134 are positioned on opposing sides of dovetail projections 122 of hard hat 100. Rear clamp 146 and mounting bracket body 134 together act as a vise to clamp onto hard hat 100.

Figure 8:
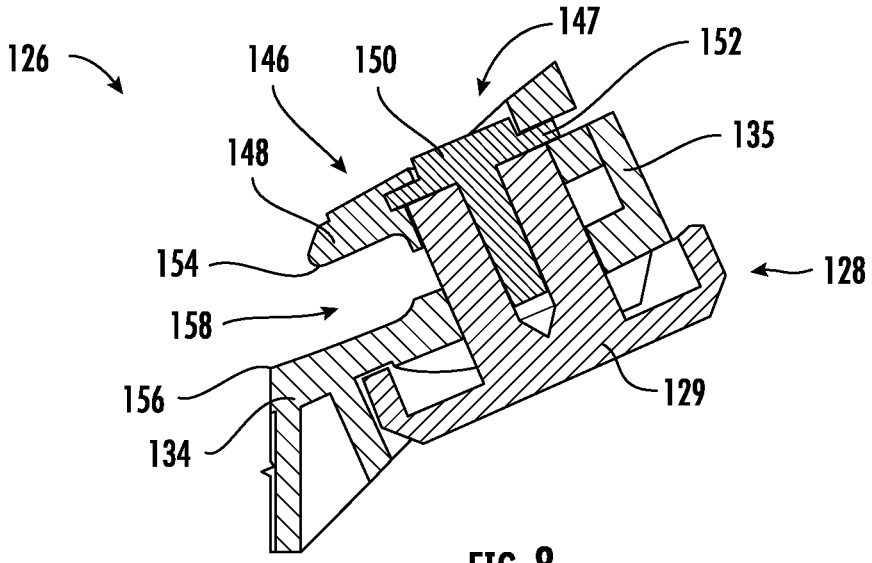
FIG. 8 is a detailed cross-sectional view of a locking portion of the accessory bracket of FIG. 2, according to an exemplary embodiment.

Referring to FIG. 8, a detailed a cross-sectional view of an end of accessory bracket 126 is shown according to an exemplary embodiment. Accessory bracket 126 includes a washer 152 positioned at least partially within rear clamp 146 between a portion of screw 150 and body portion 129 of cam lever 128. Clamping portion 148 of rear clamp 146 includes a bracket facing surface 154. Bracket facing surface 154 faces a rear surface 156 of mounting bracket body 134. A gap or space, shown as a slot 158 is defined between bracket facing surface 154 of rear clamp 146 and rear surface 156 of mounting bracket body 134. Rear clamp 148 at least partially defines slot 158. Slot 158 receives the mounting ridge 112 and removably coupled the accessory bracket 126 to the hard hat 100.

A size of slot 158 defines a distance between rear surface 156 of accessory bracket 126 and inner or bracket facing surface 154 of rear clamp 146. Slots 158 receive the mounting ridge (i.e., 12, 112, 212) and removably coupled the accessory bracket 126 to one of the front side surface (i.e., 16, 116) or rear side surface (i.e., 14, 114, 214) of the hard hat (i.e., 10, 100, 200, etc.). in other words, slots 158 act as receiving slots.

Cam lever 128 is configured to receive a portion of screw 150. When an operator actuates cam lever 128 in the first, locking direction (e.g., arrow 130 in FIG. 3), rear clamp 146 is pulled toward accessory bracket 126 or mounting bracket body 134 (space 158 is reduced) such that the rear clamp 146 and mounting bracket body 134 together act to clamp or compress onto the dovetail projections 122 (see e.g., FIG. 7) of the hard hat (e.g., 10, 100, 200). In other words, accessory bracket 126 compresses a portion of mounting ridge 112. When an operator actuates cam lever 128 in the second, unlocking direction (see e.g., arrow 132 in FIG. 4) rear clamp 146 is moved away from accessory bracket 126 or mounting bracket body 134 (a size of space 158 increases) such that rear clamp 146 and mounting bracket body 134 release the portion of mounting ridge 112 and no longer securely couple accessory bracket 126 to the hard hat. In a specific embodiment, the portion of the mounting ridge 112 is the pair or dovetail projections 122 extending outward from opposing sides of mounting ridge 112.

In other words, when cam levers 128 are actuated to distance between rear surface 156 of accessory bracket 126 and the inner surface or bracket facing surface 154 of the rear clamps is changed. Specifically, a distance between rear surface 156 of accessory bracket 126 or mounting bracket body 134 and an inner surface 154 of rear clamp 146 when cam levers 128 are in a locked position is less than a distance between rear surface 156 and the inner surface 154 of rear clamp 146 when the cam levers 128 are in an unlocked position. When accessory bracket 126 is coupled to hard hat 100, a first slot 158 at the first end of accessory bracket 126 receives and encloses one of the opposing edges or dovetail projections 122 of mounting ridge 112 and a second slot 158 located at the second end of accessory bracket 126 received and encloses one of the opposing edges 122 of mounting ridge 112. The first and second slots 158 extend downward along mounting ridge 112 in a perpendicular orientation to the axes of rotation 127.

Figure 9:
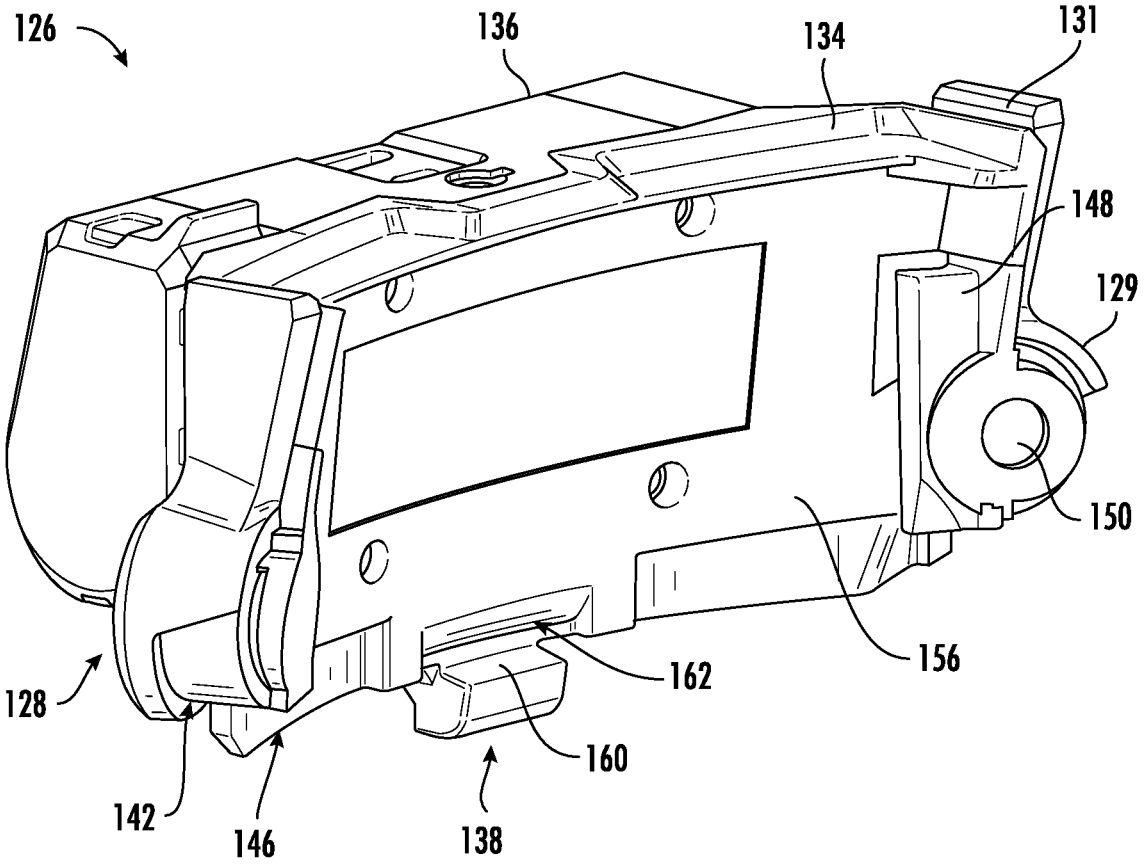
FIG. 9 is a rear perspective view of the accessory bracket of FIG. 2, according to an exemplary embodiment.

Referring to FIG. 9, a rear perspective view of the accessory bracket 126 is shown according to an exemplary embodiment. Center tab 138 extends backwards (e.g., in direction of the mounting ridge) beyond rear surface 156 of mounting bracket body 134. Center tab 138 includes a generally upward facing surface 160 that engages with the retention cleat of the hard hat when accessory bracket 126 is coupled to the hard as described above. Rear surface 156 further includes a recess 162 positioned above center tab 138. Recess 162 is sized and/or configured to receive a retention cleat and further secure the accessory bracket 126 onto a hard hat (e.g., 10, 100, 200).

Figure 10:
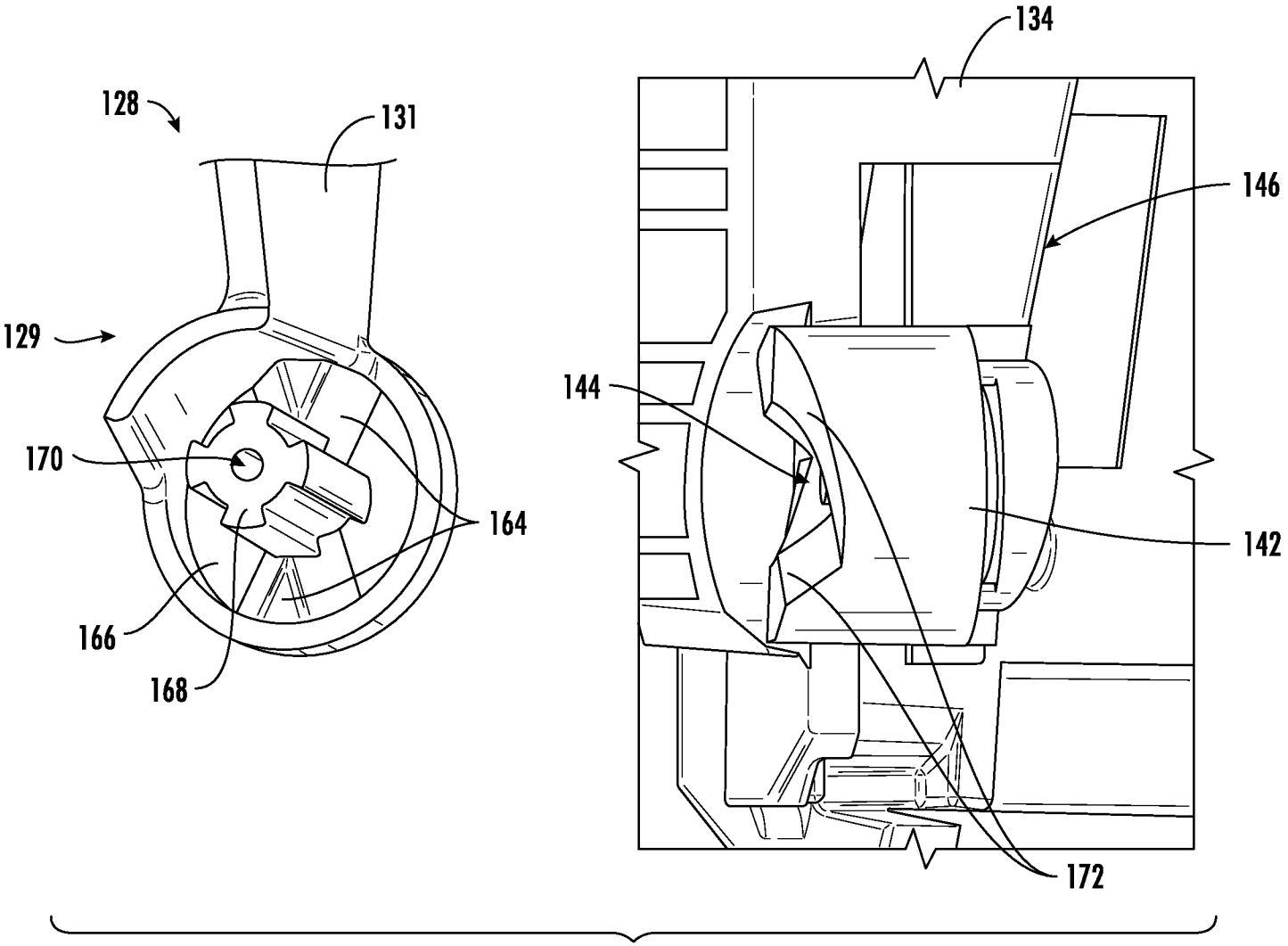
FIG. 10 is a partially exploded view of the locking portion of the accessory bracket of FIG. 2, according to an exemplary embodiment.

Referring to FIG. 10, a partially exploded view of the locking portion 142 of accessory bracket 126 is shown according to an exemplary embodiment. Cam lever 128 and specifically body 129 includes an inward facing surface 166

(e.g., toward locking portion 142 and mounting bracket body 134). Two teeth 164 are coupled to inward facing surface 166 and extending toward locking portion 142 when accessory bracket 126 is assembled. Inward facing surface 166 further includes a central projection 168 positioned between the two teeth 164. A bore 170 extends through at least a portion of central projection 168 along axis of rotation 127 when accessory bracket 126 is assembled. When assembled, central projection 168 is received within and coupled to mounting bracket body 134 and rear clamp 146 while bore 170 receives an end portion of screw 150 (see e.g., FIG. 8).

Locking portion 142 includes a pair of ramps 172 extending around bore 144. When an operator actuates cam lever 128 in the locking direction, the two teeth 164 move or slide up the pair of ramps 172 creating a clamping force to pull rear clamp 146 toward mounting bracket body 134 such that rear clamp 146 and mounting bracket body 134 couple accessory bracket 126 to the hard hat (e.g., 10, 100, 200).

Figure 11:
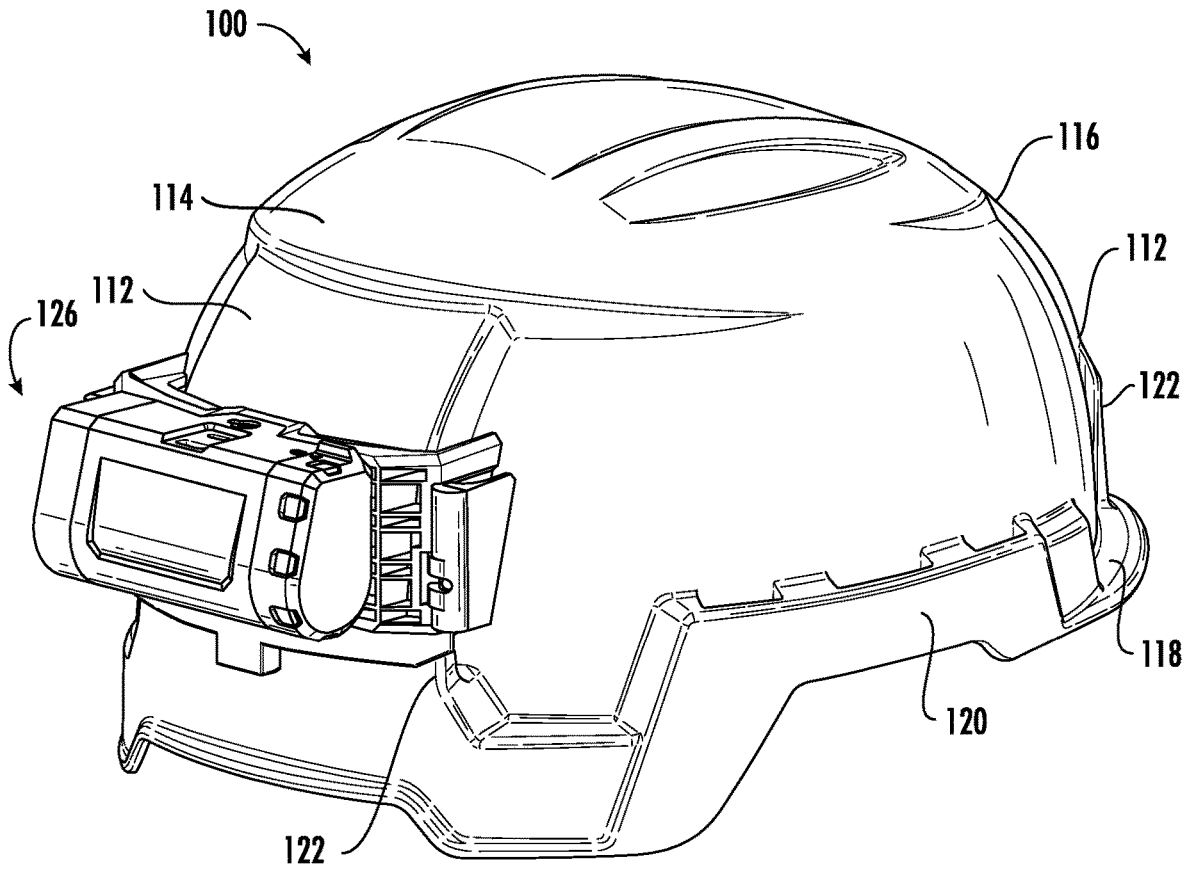
FIG. 11 is a perspective view of a hard hat connected to an accessory bracket at a rear mounting location of the hard hat, according to another exemplary embodiment.

Referring to FIG. 11, a perspective view of a hard hat 100 connected to an accessory bracket 226 is shown according to an exemplary embodiment. Accessory bracket 226 can also be utilized with hard hats 10 or 100 and is substantially the same as accessory bracket 126 except for the differences discussed herein. Accessory bracket 226 is coupled or connected to hard hat 100 and specifically to dovetail projections 122 of mounting ridge 112 located on rear side surface 114 of hard hat 100. Accessory bracket 226 can also be coupled to mounting ridge 112 positioned on front side surface 116 of hard hat 100.

Figure 12:
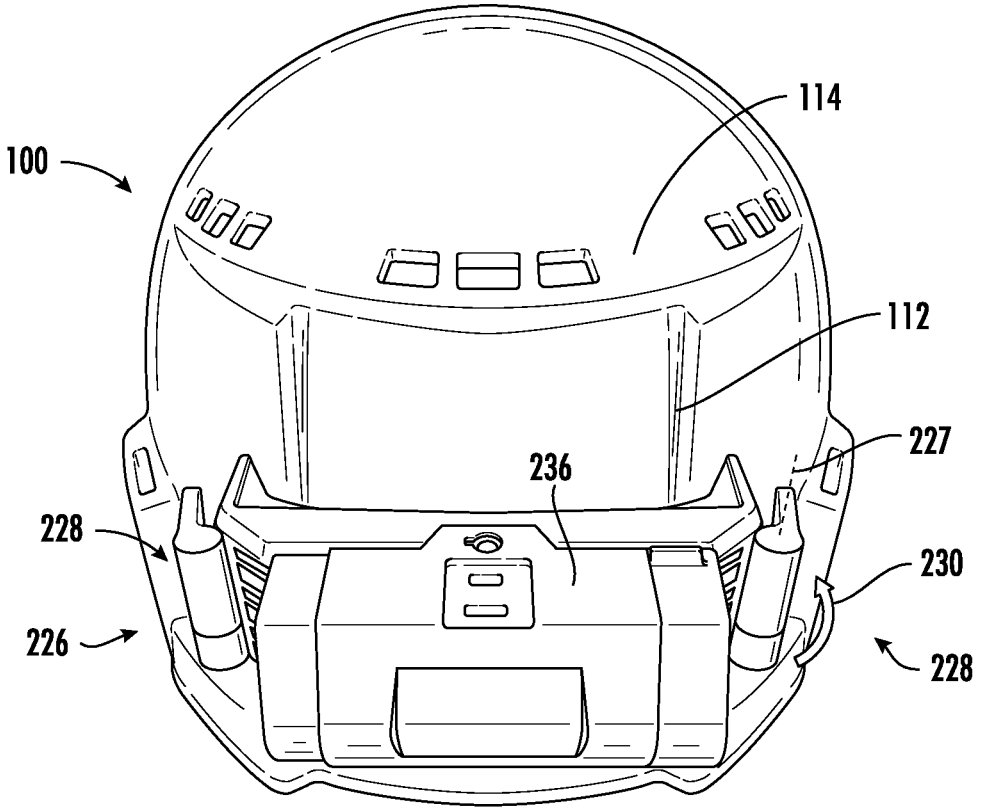
FIG. 12 is a perspective view of the hard hat connected to the accessory bracket of FIG. 11, with the accessory bracket shown in a first, locked position, according to an exemplary embodiment.

Referring to FIG. 12, a perspective view of a hard hat 100 connected to accessory bracket 226 which is in a first, locked position is shown according to an exemplary embodiment. Accessory bracket 226 includes a pair of cam levers 228 configured to lock accessory bracket 226 onto mounting ridge 112 and specifically to the dovetail projections (see e.g., 122 of FIG. 11) of hard hat 100. When an operator actuates cam levers 228 in the first, locking direction shown by arrow 230, cam levers 228 are rotated about a longitudinal or vertical axis of rotation 227. When cam levers 228 are in a locked position, accessory bracket 226 clamps or compresses onto the dovetail projections of hard hat 100 to securely couple accessory bracket 226 to the mounting ridge 112 of the hard hat 100.

Figure 13:
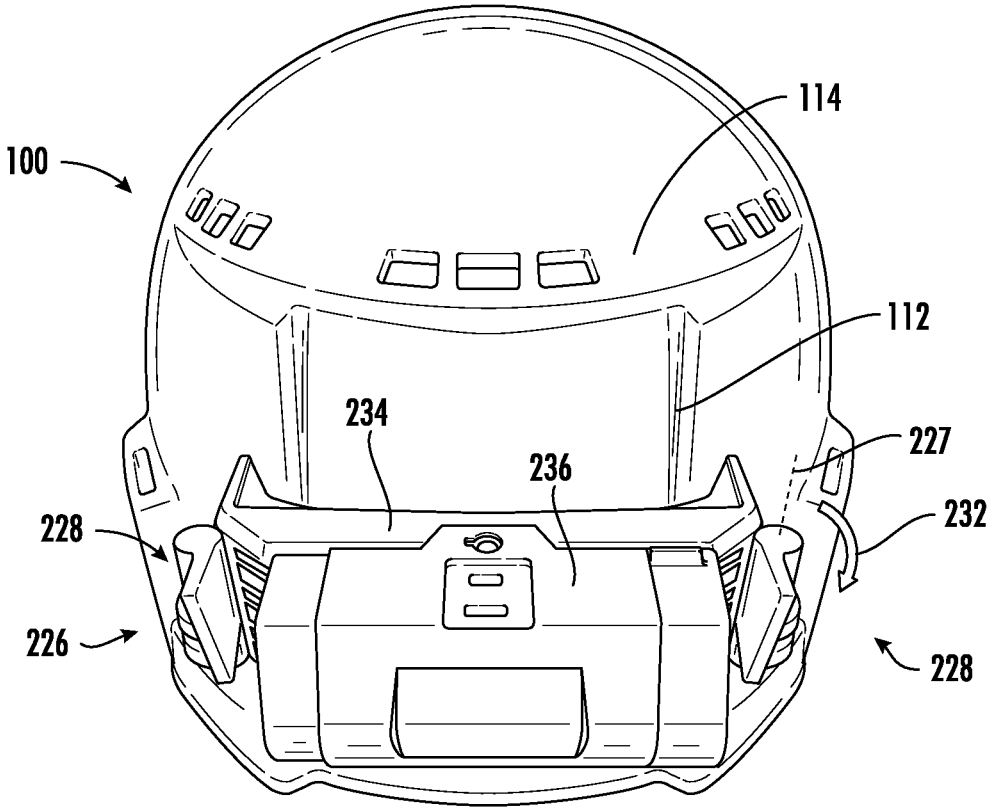
FIG. 13 is a perspective view of the hard hat connected to the accessory bracket of FIG. 11, with the accessory bracket shown in a second, unlocked position, according to an exemplary embodiment.

Referring to FIG. 13, a perspective view of a hard hat 100 connected to accessory bracket 226 which is in a second, unlocked position is shown according to an exemplary embodiment. When the operator actuates cam levers 228 in the second, unlocking direction shown by arrow 232, cam levers 228 are rotated about longitudinal axis of rotation 227. When cam levers 228 are in the unlocked position, accessory bracket 226 unclamps and no longer compresses the dovetail projections (see e.g., 122 of FIG. 11) of hard hat 100 to securely couple accessory bracket 226 to the mounting ridge 112 of the hard hat 100.

Figure 14:
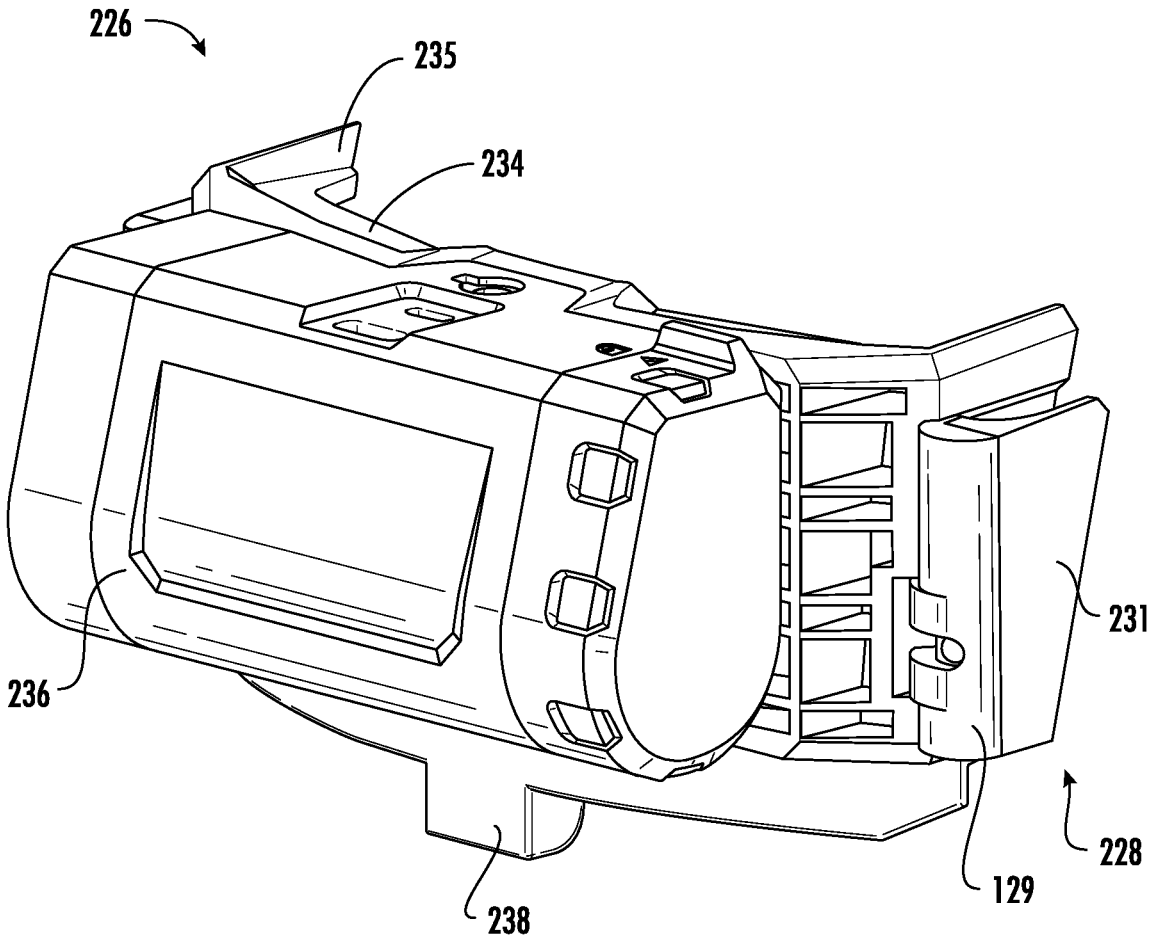
FIG. 14 is a perspective view of the accessory bracket of FIG. 11, according to an exemplary embodiment.

Referring to FIG. 14, a perspective view of accessory bracket 226 is shown according to an exemplary embodiment. Accessory bracket 226 includes a mounting bracket body 234 coupled to an accessory, shown as a battery pack 236 at a front connection portion 240 (see e.g., FIG. 15) of mounting bracket body 234. Accessory bracket 226 further includes a tab, shown as center tab 238 extending downward from the mounting bracket body 234 toward the brim of a hard hat. Center tab 238 is configured to grip and/or hold onto a retention cleat or detent (see e.g., 24 of FIG. 1) of the hard hat (e.g., 10, 100, 200). Accessory bracket 226 further includes opposing end projections 235. Each end projection 235 extends backward (e.g., direction away from battery pack 236) from the mounting bracket body 234 on opposing sides of the front connection portion 240. Each cam lever 228 is positioned at least partially against a respective end projection 235.

Figure 15:
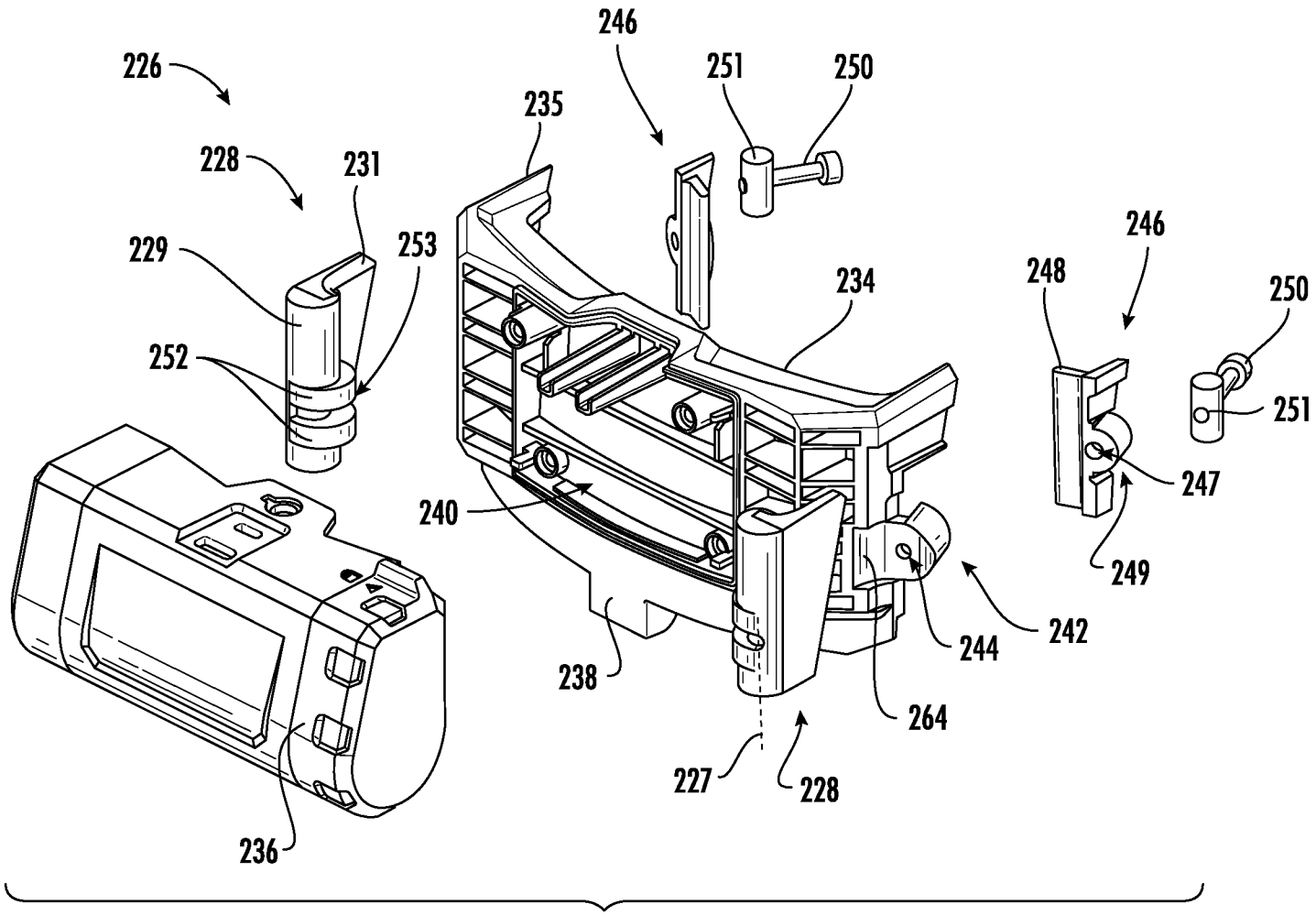
FIG. 15 is an exploded view of the accessory bracket of FIG. 11, according to an exemplary embodiment.

Referring to FIG. 15, an exploded view of the accessory bracket 226 is shown according to an exemplary embodiment. Mounting bracket body 234 further includes a pair of locking portions 242 on opposing sides of the front connection portion 240 below the opposing end projections 235. Cam levers 228 are rotatably coupled to locking portions 242 and locking portions 242 have a shape corresponding to cam levers 228. Each locking portion 242 includes a bore 244 extending through the locking portion 242 in an orientation generally perpendicular (e.g., 90 degrees±10 degrees) to longitudinal axis of rotation 227.

Accessory bracket 226 includes a pair of rear clamps 246. Each rear clamp 246 includes a clamping portion 248 and a clamp locking portion 249. Each clamp locking portion 249 includes a bore 247 extending through the locking portion 249 and positioned behind bore 244 of locking portion 242. A connector, shown as a bolt 250 extends through bore 247 of clamp locking portion 249 and bore 244 of the mounting bracket body 234 when accessory bracket 226 is assembled. Each cam lever 228 is configured to receive a barrel nut 251 and a portion of bolt 250. Bolt 250 extends from within cam lever 228 and barrel nut 251 through at least partially through locking portion 242 and rear clamp 246.

Each cam lever 228 includes a body portion 229 and a lever portion 231. In a specific embodiment, the body portion 229 has a partially cylindrical shape extending along axis of rotation 227. Body portion 229 of cam lever 228 includes extended portions 252 positioned along axis of rotation 227. A gap or space 253 is defined between extended portions 252 and is configured to receive barrel nut 251 when accessory bracket 226 is assembled.

Figure 16:
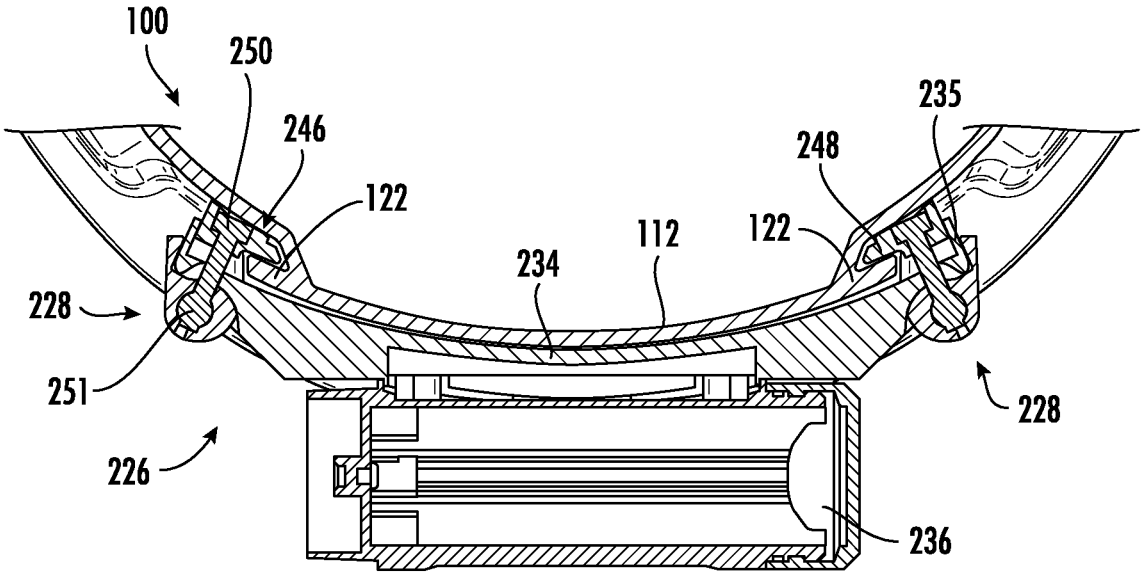
FIG. 16 is a cross-sectional view of the accessory bracket of FIG. 11, according to an exemplary embodiment.

Referring to FIG. 16, a cross-sectional view of the accessory bracket 226 coupled to hard hat 100 is shown according to an exemplary embodiment. As shown in FIG. 16, when accessory bracket 226 is connected to mounting ridge 112, clamping portion 248 of rear clamp 246 and mounting bracket body 234 are positioned on opposing sides of dovetail projections 122 of hard hat 100. Rear clamp 246 and mounting bracket body 234 together act as a vise to clamp onto hard hat 100.

Figure 17:
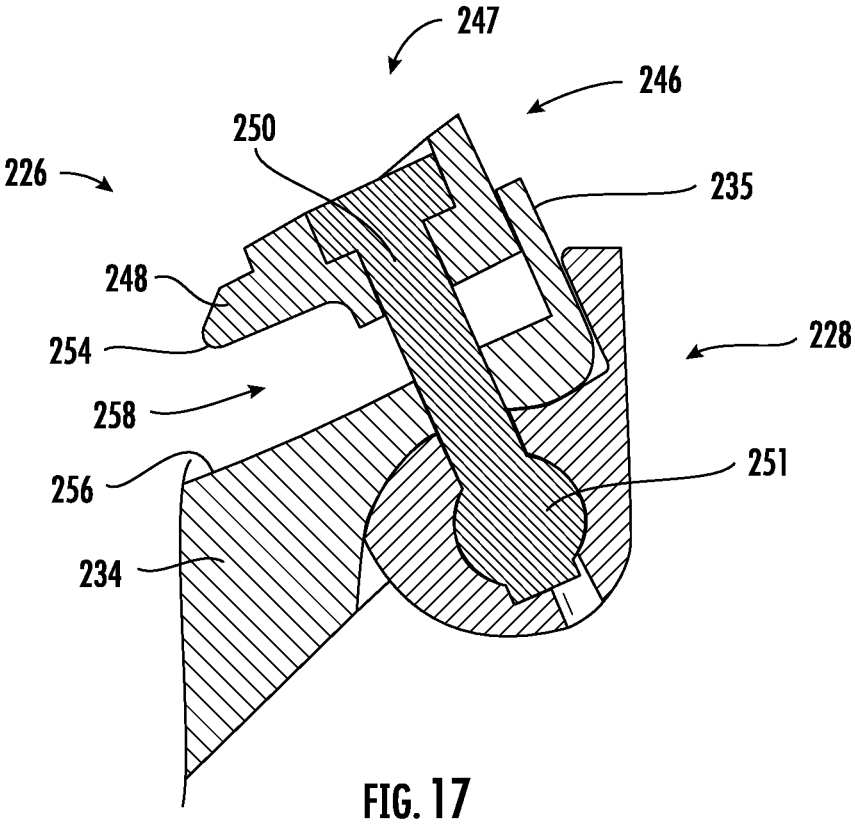
FIG. 17 is a detailed cross-sectional view of a locking portion of the accessory bracket of FIG. 11, according to an exemplary embodiment.

Referring to FIG. 17, a detailed a cross-sectional view of an end of accessory bracket 226 is shown according to an exemplary embodiment. Clamping portion 248 of rear clamp 246 includes a bracket facing surface 254. Bracket facing surface 254 faces a rear surface 256 of mounting bracket body 234. A gap or space, shown as a slot 258 is defined between bracket facing surface 254 of rear clamp 246 and rear surface 256 of mounting bracket body 234. When an operator actuates cam levers 228 in the first, locking direction (e.g., arrow 230 in FIG. 12), rear clamps 246 are pulled toward mounting bracket body 234 (space 258 is reduced) such that the rear clamps 246 and mounting bracket body 234 together act to clamp or compress onto the dovetail projections 122 (see e.g., FIG. 16) of the hard hat (e.g., 10, 100, 200). When an operator actuates cam levers 228 in the second, unlocking direction (see e.g., arrow 232 in FIG. 13) a size of space 258 increases such that rear clamps 246 and mounting bracket body 234 no longer securely couple accessory bracket 226 to the hard hat.

Figure 18:
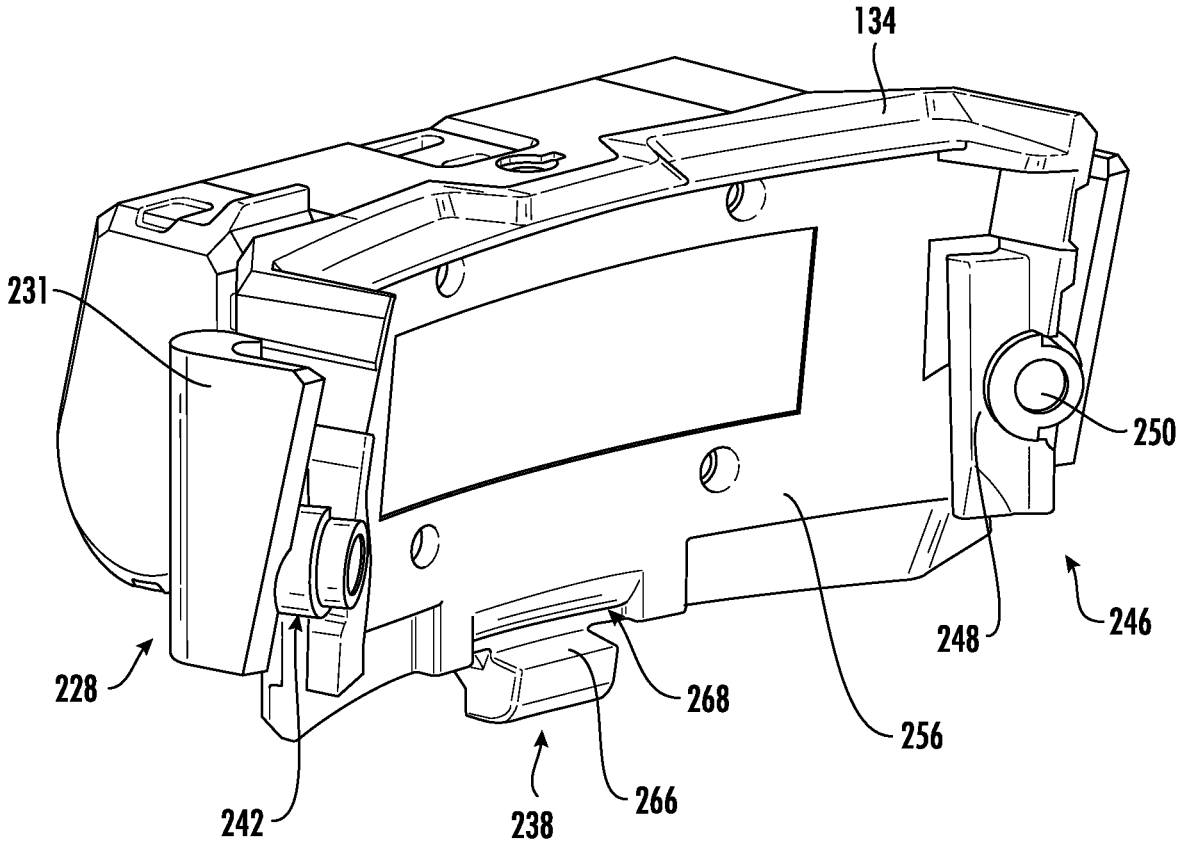
FIG. 18 is a rear perspective view of the accessory bracket of FIG. 11, according to an exemplary embodiment.

Referring to FIG. 18, a rear perspective view of the accessory bracket 226 is shown according to an exemplary embodiment. Center tab 238 extends backwards (e.g., in direction of the mounting ridge) beyond (e.g., closer to mounting ridge of the hard hat) rear surface 256 of mounting bracket body 234. Center tab 238 includes a generally upward facing surface 266 that engages with the retention cleat of the hard hat when accessory bracket 226 is coupled to the hard as described above. Rear surface 256 further includes a recess 268 positioned above center tab 238. Recess 268 is configured to receive a retention cleat and further secure the accessory bracket 226 onto a hard hat (e.g., 10, 100, 200).

Referring to FIGS. 19-22, various aspects of a mounting bracket, shown as accessory bracket 326 are shown. Accessory bracket 326 can be utilized with hard hats 10, 100, and 200. Accessory bracket 326 is substantially the same as accessory brackets 126 and 226 except for the differences discussed herein.

Figure 19:
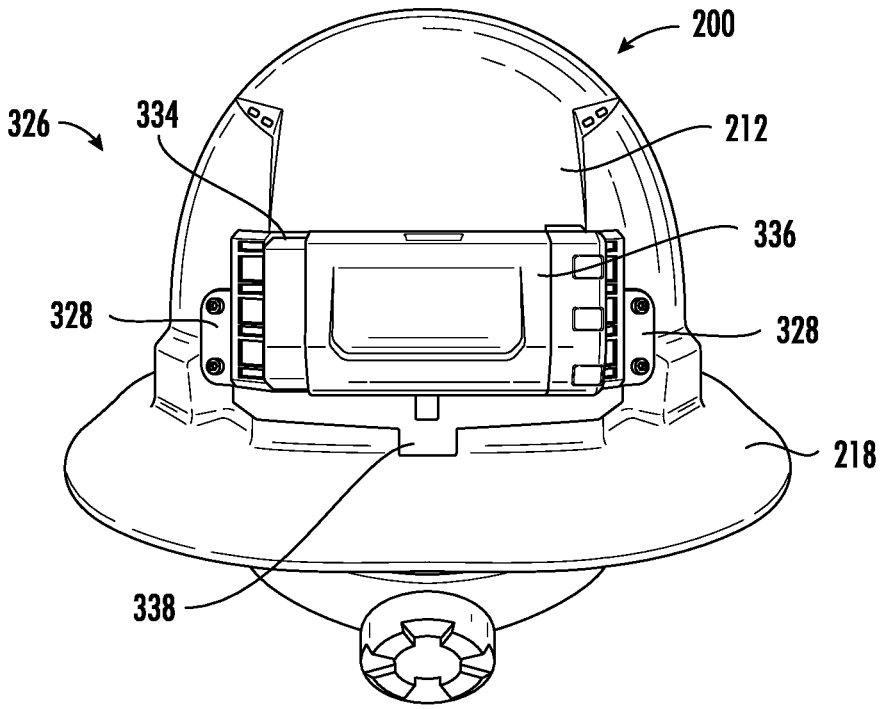
FIG. 19 is a perspective view a hard hat connected to an accessory bracket at a rear mounting location of the hard hat, according to another exemplary embodiment.
Figure 20:
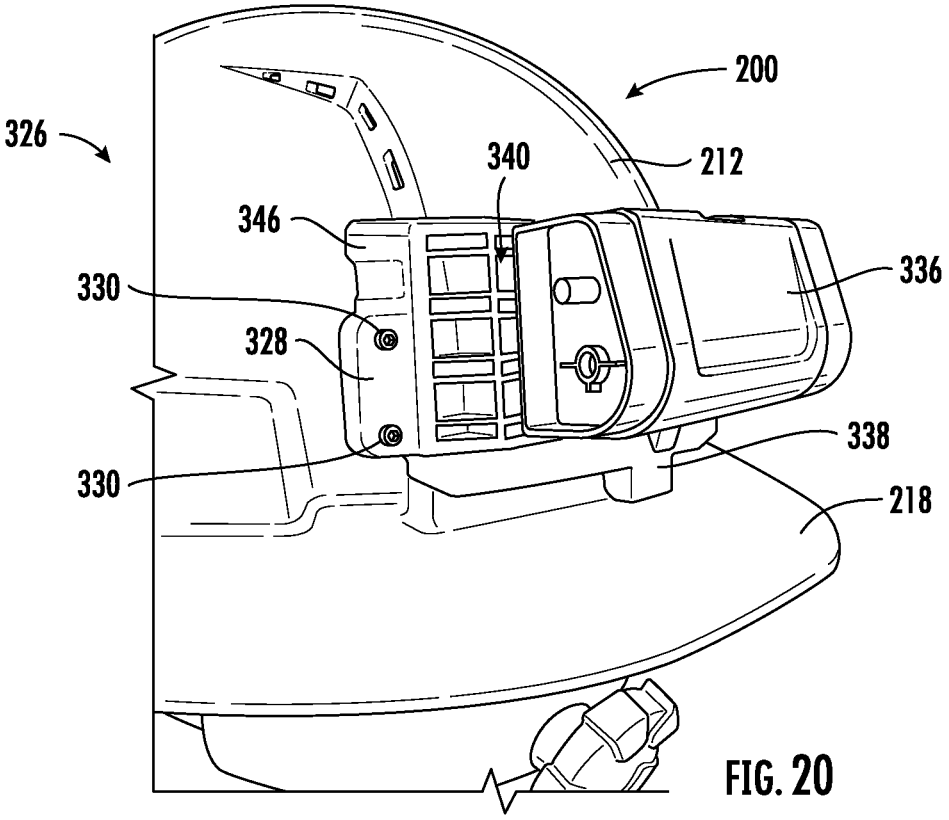
FIG. 20 is a left-side perspective view of the hard hat connected to the accessory bracket of FIG. 19, according to an exemplary embodiment.

Referring to FIGS. 19-20, perspective views of accessory bracket 326 connected or mounted to hard hat 200 and specifically to mounting ridge 212 are shown according to an exemplary embodiment. Accessory bracket 326 includes a mounting bracket body 334 coupled to an accessory, shown as a battery pack 336 at a front connection portion 340 of mounting bracket body 334. Accessory bracket 326 further includes a center tab 338 extending downward from the mounting bracket body 334 toward the brim 218 of hard hat 200. Center tab 338 is configured to grip and/or hold onto a retention cleat or detent (see e.g., 24 of FIG. 1) of hard hat 200.

Figure 21:
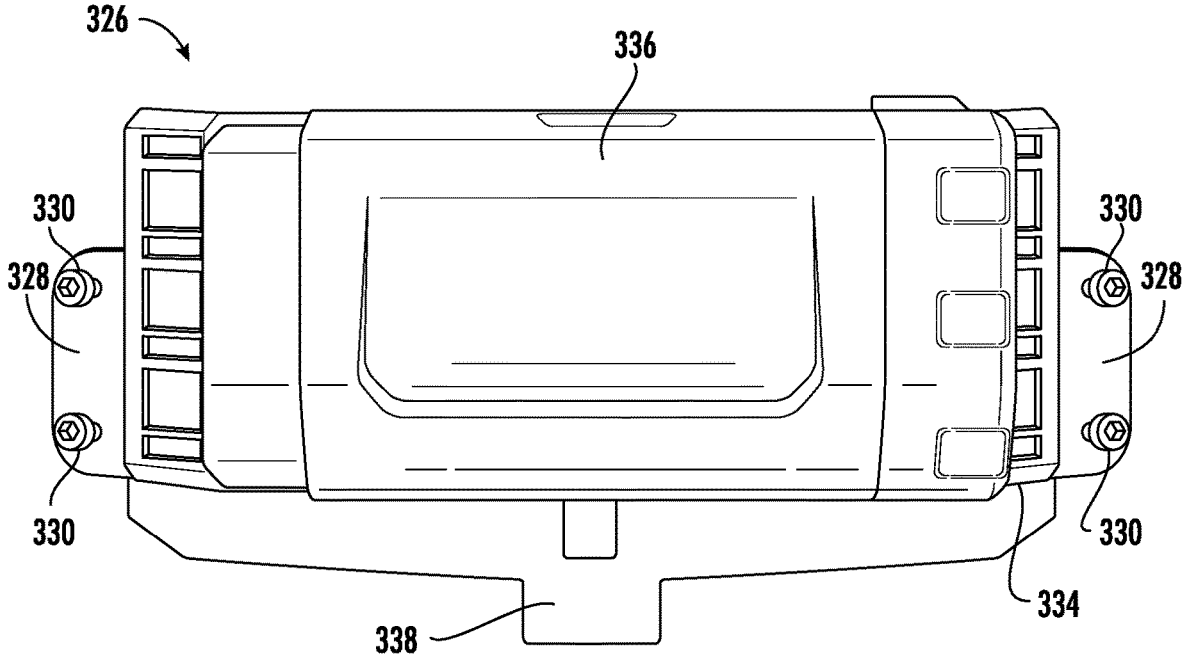
FIG. 21 is a front side view of the accessory bracket of FIG. 19, according to an exemplary embodiment.
Figure 22:
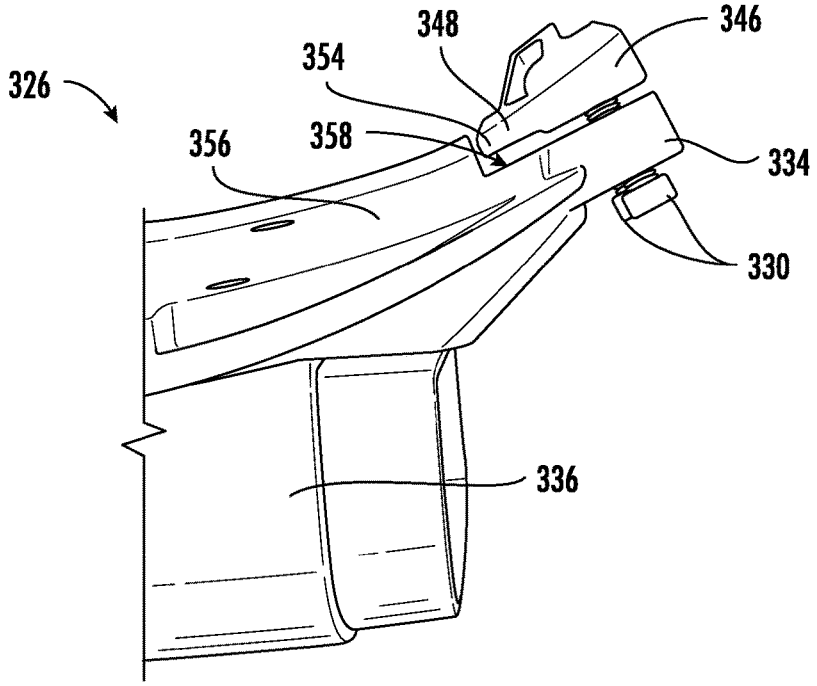
FIG. 22 is a top view of the accessory bracket of FIG. 19, according to an exemplary embodiment.

Referring to FIGS. 21-22, accessory bracket 326 further includes opposing side connection portions 328. Each side connection portion 328 extends outward from the mounting bracket body 334 on opposing sides of the front connection portion 340. Each side connection portion 328 is coupled to a rear clamp 346 by one or more connectors, shown as screws 330. In a specific embodiment each side connection portion 328 is coupled to the rear clamp 346 by two screws 330. In other embodiments, the side connection portion 328 and rear clamp portion may be coupled by fewer or more screws 330 (e.g., 1, 3, etc.). The rear clamp 346 includes a clamping portion 348 with a bracket facing surface 354. Bracket facing surface 354 of clamping portion 348 faces a rear surface 356 of mounting bracket body 334. A gap or space, shown as a slot 358 is defined between bracket facing surface 354 of rear clamp 346 and rear surface 356 of mounting bracket body 334.

When an operator tightens (e.g., turns in a clockwise direction) screws 330, rear clamps 346 are pulled toward mounting bracket body 334 such that the rear clamps 346 and mounting bracket body 334 together act as a vice clamping or gripping onto the dovetail projections (see e.g., 22 of FIG. 1) to securely couple accessory bracket 326 to mounting ridge 212 of hard hat 200. When an operator loosens (e.g., turns in a counterclockwise direction) screws 330, rear clamps 346 move away from mounting bracket body 334 such that the rear clamps 346 and mounting bracket body 334 together release the dovetail projections (see e.g., 22 of FIG. 1) such that couple accessory bracket 326 is no longer securely coupled to mounting ridge 212 of hard hat 200.

Figure 23:
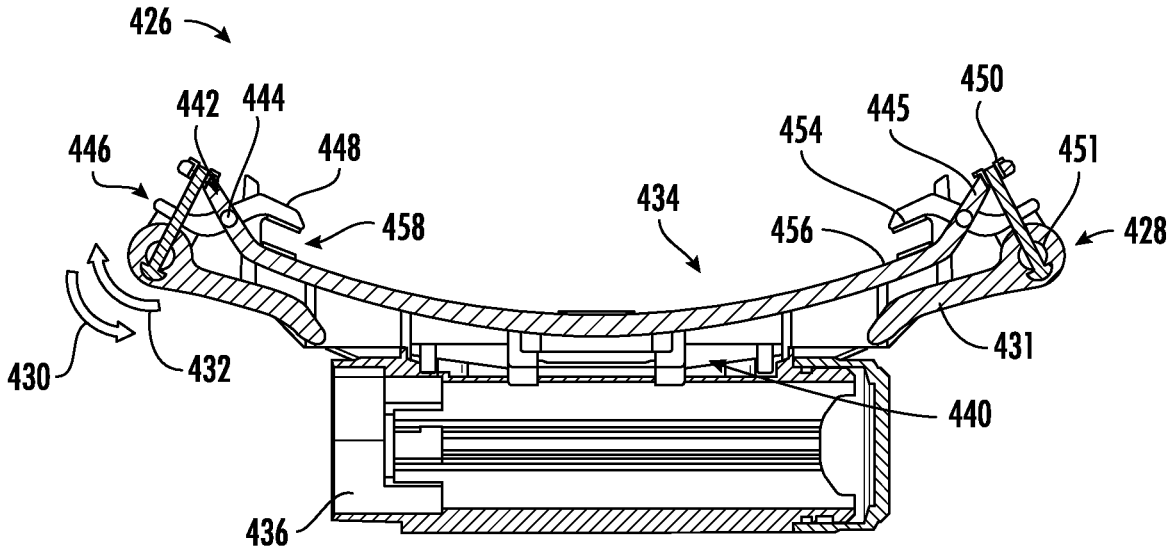
FIG. 23 is a cross-sectional view of an accessory bracket, according to another exemplary embodiment.

Referring to FIG. 23, a cross-sectional view of an accessory bracket 426 is shown, according to an exemplary embodiment. Accessory bracket 426 can be utilized with hard hats 10, 100, and 200. Accessory bracket 426 is substantially the same as accessory brackets 126, 226, and 326 except for the differences discussed herein. Accessory bracket 426 includes a mounting bracket body 434 coupled to an accessory, shown as a battery pack 436 at a front connection portion 440 of mounting bracket body 434.

Accessory bracket 426 further includes opposing end portions 445. Each end portion 445 extends outward from the mounting bracket body 434 on opposing sides of the front connection portion 440. In a specific embodiment, end portions 445 are angled back (in orientation of FIG. 24) away from battery pack 436. Each end portion 445 is coupled to a rear clamp 446 by a connector, shown as a pin 444 at a hinge point 442. The rear clamp 446 includes a clamping portion 448 with a bracket facing surface 454. Bracket facing surface 454 of clamping portion 448 faces a rear surface 456 of mounting bracket body 434. A gap or space, shown as a slot 458 is defined between bracket facing surface 454 of rear clamp 446 and rear surface 456 of mounting bracket body 434.

Accessory bracket 426 further includes one or more cam levers 428 coupled to rear clamp 446 and/or end portion 445. Cam lever 428 is configured to receive a barrel nut 451 and a connector, shown as a bolt 450. Bolt 450 extends from within cam lever 428 and barrel nut 451 through at least a portion of rear clamp 446 and end portion 445. When an operator actuates cam levers 428 in a first, locking direction shown by arrow 430, bolts 450 and rear clamps 446 are pulled toward mounting bracket body 434 such that the rear clamps 446 and mounting bracket body 434 together act to clamp or compress onto the dovetail projections (see e.g., 22 of FIG. 1) of a hard hat to couple accessory bracket 426 to a mounting ridge (e.g., 12, 112, 212) of the hard hat (e.g., 10, 100, 200). When an operator actuates cam levers 428 in a second, unlocking direction shown by arrow 432, a size of space 458 increases such that rear clamps 446 and mounting bracket body 434 no longer compress onto the dovetail projections of the hard hat.

Figure 24:
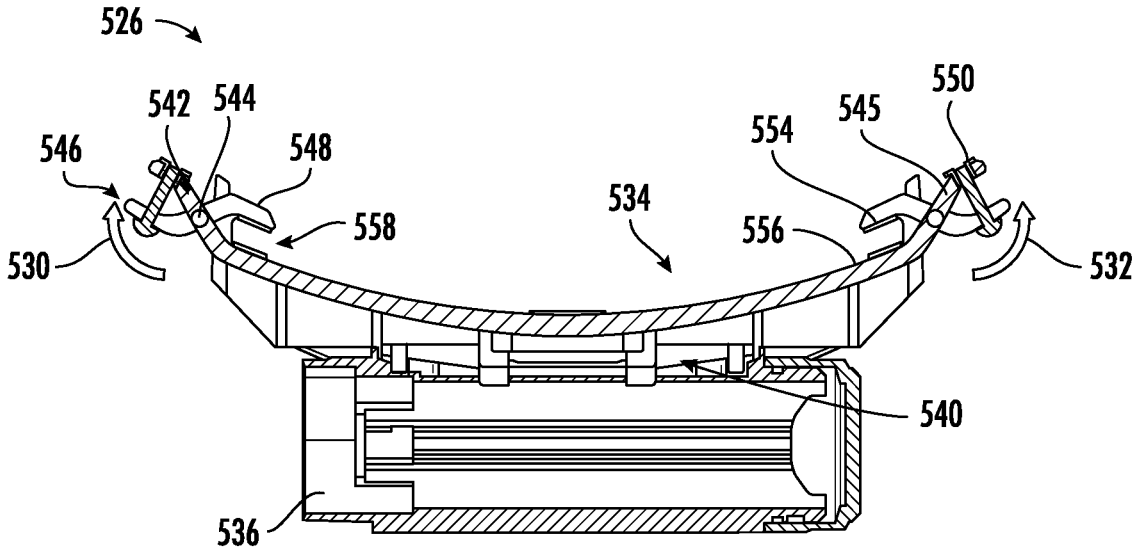
FIG. 24 is a cross-sectional view of an accessory bracket, according to another exemplary embodiment.

Referring to FIG. 24, a cross-sectional view of an accessory bracket 526 is shown, according to an exemplary embodiment. Accessory bracket 526 can be utilized with hard hats 10, 100, and 200. Accessory bracket 526 is substantially the same as accessory bracket 426 except for the differences discussed herein. Accessory bracket 526 includes a mounting bracket body 534 coupled to an accessory, shown as a battery pack 536 at a front connection portion 540 of mounting bracket body 534.

Accessory bracket 526 further includes opposing end portions 545. Each end portion 545 extends outward from the mounting bracket body 534 on opposing sides of the front connection portion 540. In a specific embodiment, end portions 545 are angled back (in orientation of FIG. 25) away from battery pack 536. Each end portion 545 is coupled to a rear clamp 546 by a connector, shown as a pin 544 at a hinge point 542. The rear clamp 546 includes a clamping portion 548 with a bracket facing surface 554. Bracket facing surface 554 of clamping portion 548 faces a rear surface 556 of mounting bracket body 534. A gap or space 558 is defined between bracket facing surface 554 of rear clamp 546 and rear surface 556 of mounting bracket body 534.

Instead of actuating cam levers like with accessory bracket 426, an operator tightens connectors, shown as screws 550 by turning them in first, locking direction shown by arrow 530. When screws 550 are tightened, a pair of rear clamps 546 and mounting bracket body 534 together act as a vice clamping or gripping onto the dovetail projections (see e.g., 22 of FIG. 1) of a hard hat to couple accessory bracket 526 to the hard hat. To unclamp accessory bracket 526, an operator loosens screws 550 by turning them in a second, unlocking direction shown by arrow 532.

Figure 25:
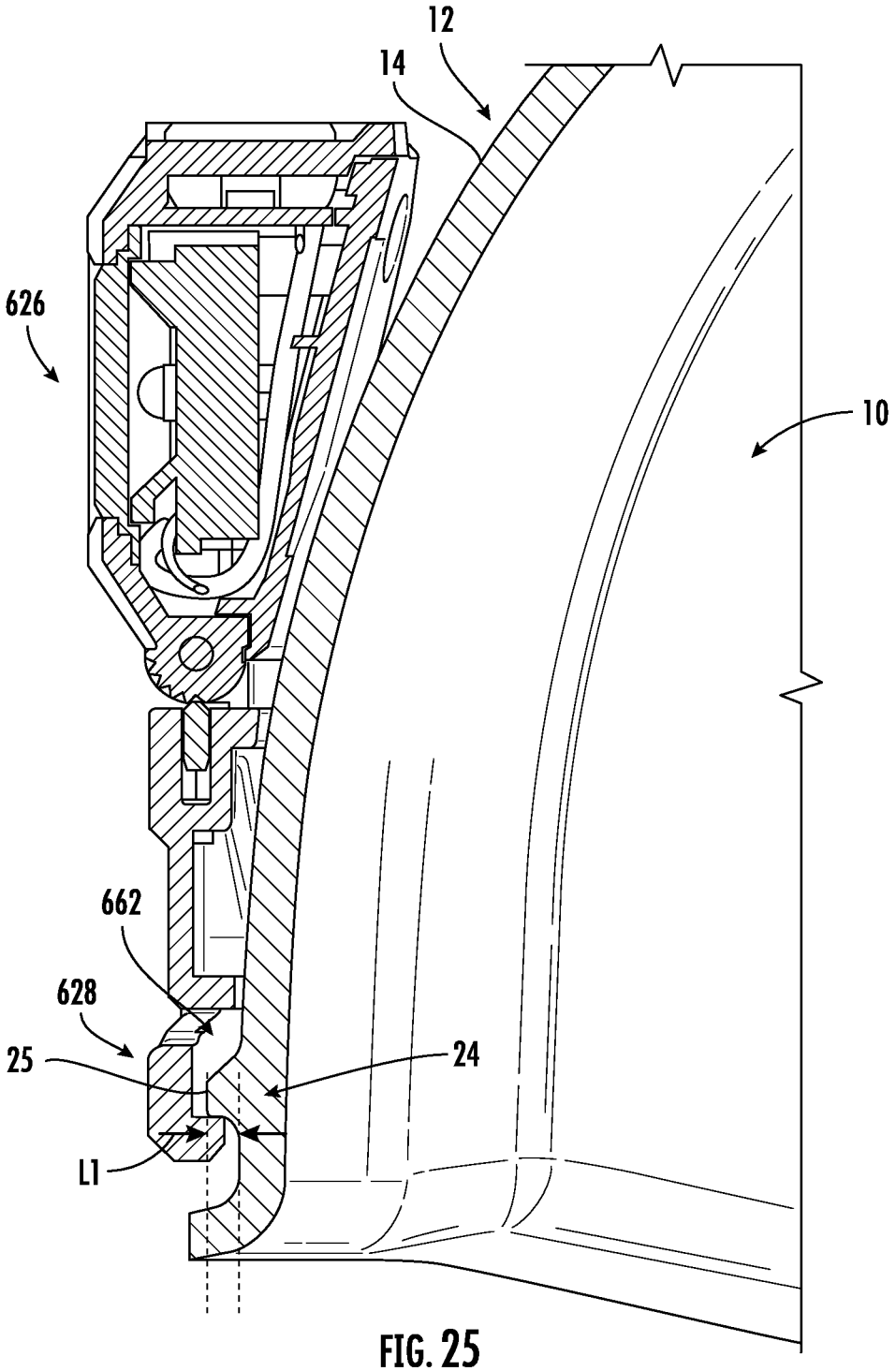
FIG. 25 is a cross-sectional view of a rear mounting location of the hard hat of FIG. 1, according to an exemplary embodiment.

Referring to FIG. 25, a cross-sectional view of a rear mounting location of a hard hat 10 and specifically retention cleat 24 is shown according to an exemplary embodiment. As previously discussed, retention cleat 24 extends outward from rear side surface 14 of mounting bracket 12 on hard hat 10. Retention cleat 24 is configured to be grasped and/or held onto by an accessory bracket 626 central tab 628 and recess 662 positioned at least partially within central tab 628. Retention cleat 24 includes a length, L1 defined between rear side surface 14 of hard hat 100 and an outer surface 25 of retention cleat 24.

Figure 26:
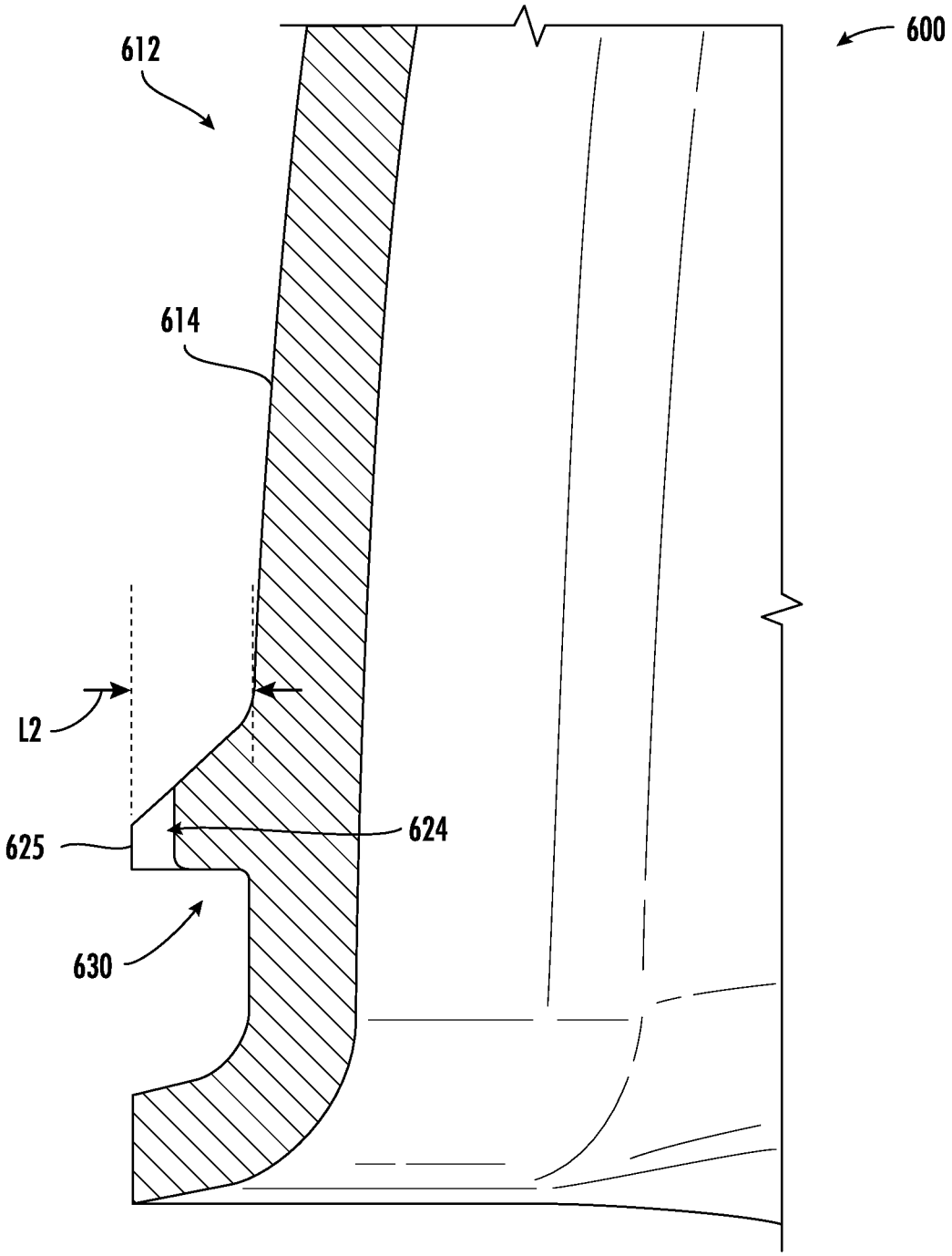
FIG. 26 is a cross-sectional view of a rear mounting location of a hard hat, according to another exemplary embodiment.

Referring to FIG. 26, a cross-sectional view of a rear mounting location of a hard hat 600 and specifically retention cleat or detent 624 is shown according to an exemplary embodiment. Hard hat 600 includes a mounting bracket 612 on a rear side surface 614. Retention cleat 624 is designed with an increased size relative to retention cleat 24. The size of retention cleat 624 allows for the mounting of heavier accessories on a hard hat 600 relative to hard hat 10 because the larger size of retention cleat 624 makes it more difficult for the accessory bracket 626 to become loose or slide off retention cleat 624 (e.g., accessory is more likely to remain coupled to the hard hat because deformation caused by heavy accessory is overcome) if there is any impact or falling of the hard hat.

Retention cleat 624 includes a length, L2 defined between rear side surface 614 of hard hat 600 and an outer surface 625 of retention cleat 624. In a specific embodiment, L2 is greater than L1. A bottom surface 630 of retention cleat 624 is planar. Applicant believes use of a planar bottom surface 630 for retention cleat 624 further increases the likelihood that accessory bracket 626 remains coupled to retention cleat 624 if there is any impact on hard hat 600 compared to a retention cleat with a curved bottom surface (see e.g., 24 of FIG. 26).

Figure 27:
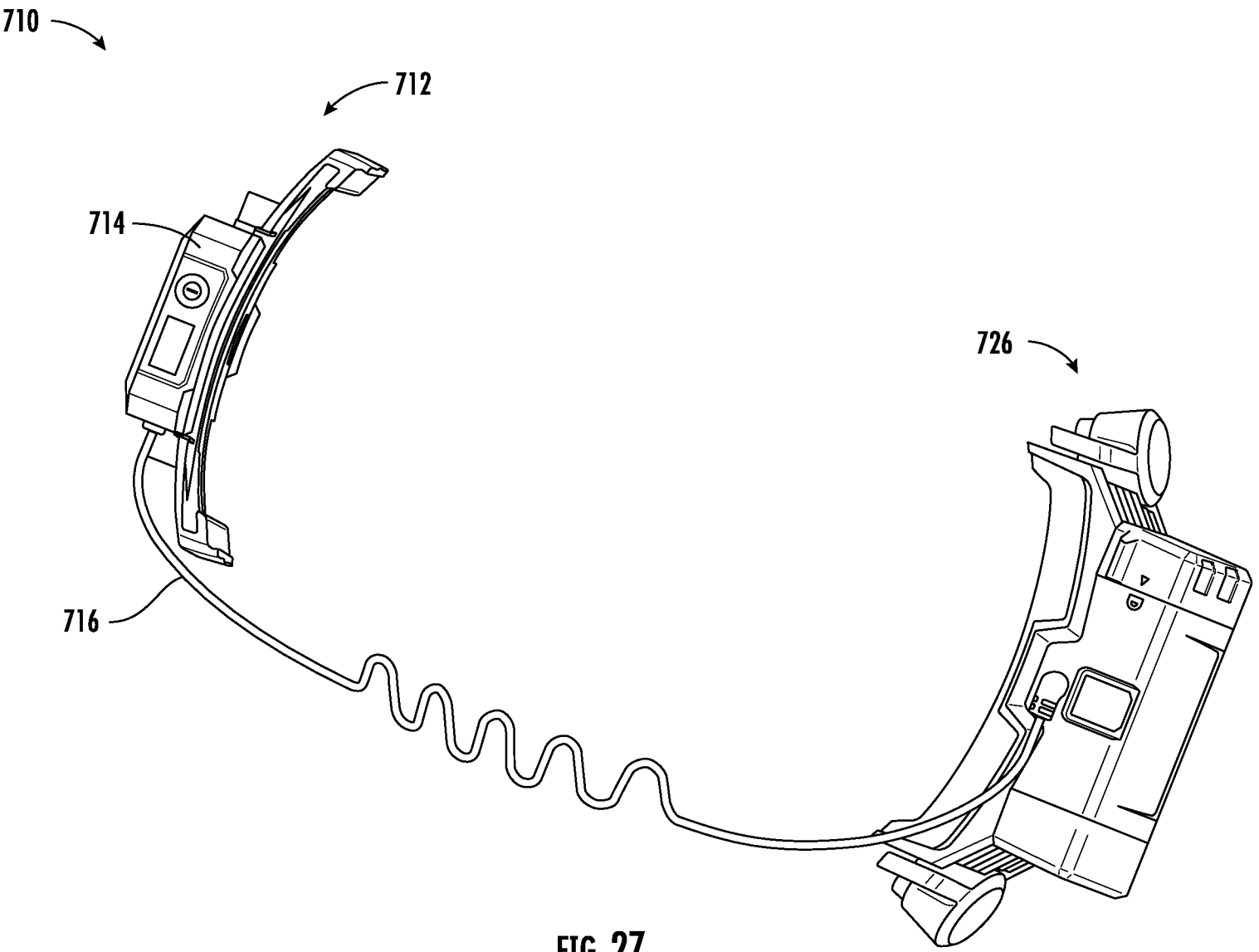
FIG. 27 is a perspective view of a lamp mounting bracket and an accessory bracket according to another exemplary embodiment.

Referring to FIG. 27, an accessory mounting system shown as a lighted mounting system 710, is shown according to an exemplary embodiment. Headlamp mounting system 710 includes a rigid mounting bracket 712 and an accessory mounting bracket 726. Rigid mounting bracket 712 securely and removably mounts to either a front mounting ridge and/or rear mounting ridge (i.e., 12, 112, 212 etc.) of the hard hat (i.e., 10, 100, 200 etc.). Headlamp mounting system 710 can be utilized with a hard hat (e.g., 10, 100, 200) and/or coupled to a mounting ridge (e.g., 12, 112, 212) of the hard hat (e.g., 10, 100, 200).

In general, the lighted mounting system 710 discussed herein includes a lamp 714. Lamp 714 is electronically coupled to a power source, such as a battery pack by a wire 716. The battery pack can be coupled to the accessory mounting bracket 726 that can be mounted on an opposing mounting ridge of a hard hat (e.g., rigid mounting bracket 712 positioned on a front ridge and accessory mounting bracket 726 on a rear mounting ridge of a hard hat.

Figure 28:
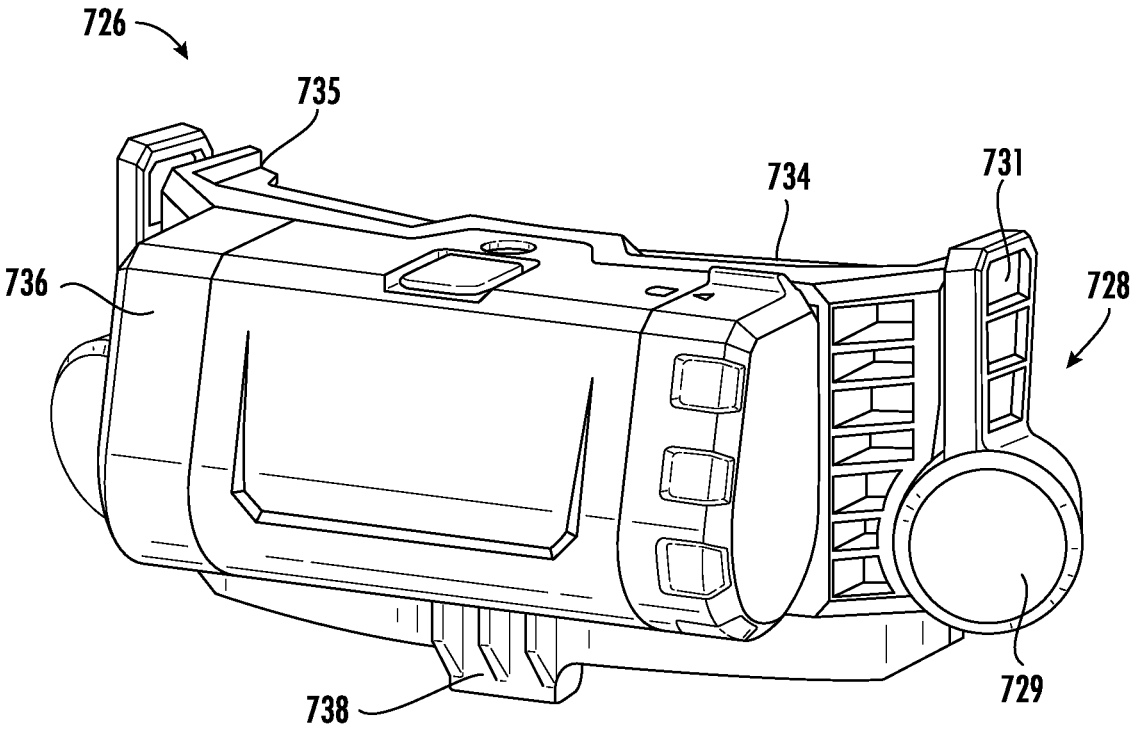
FIG. 28 is a perspective view of the accessory bracket of FIG. 27, according to an exemplary embodiment.
Figure 29:
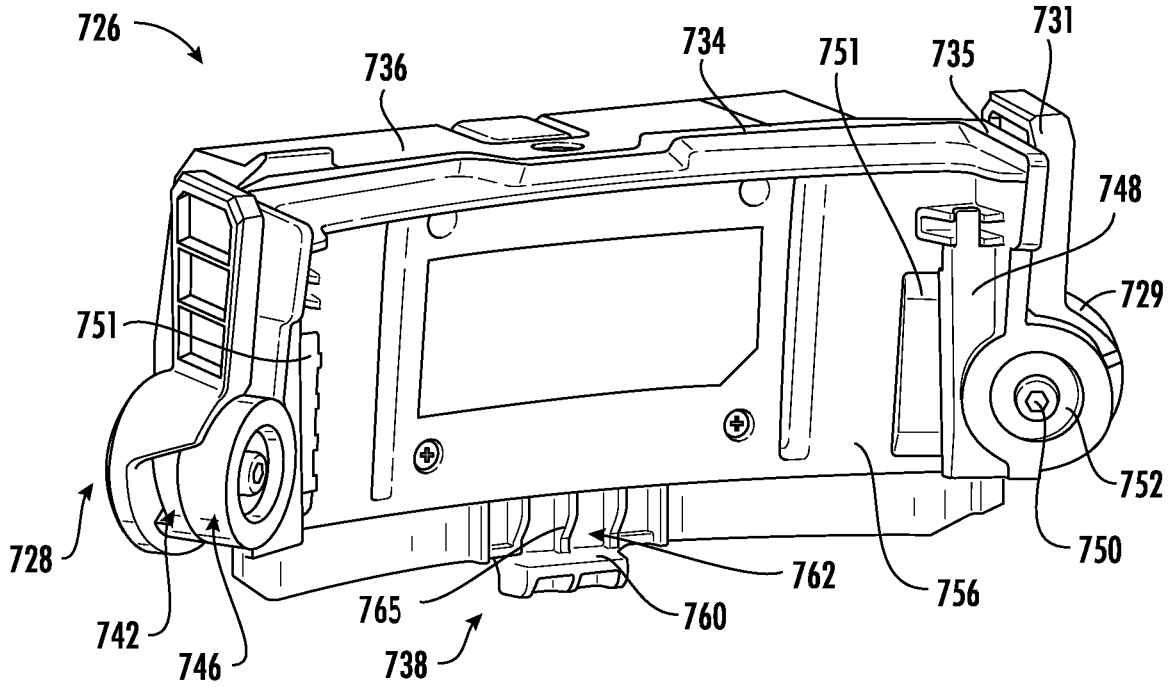
FIG. 29 is a rear perspective view of the accessory bracket of FIG. 27, according to an exemplary embodiment.

Referring to FIGS. 28-29, perspective views of the accessory bracket 726 are shown according to an exemplary embodiment. Accessory bracket 726 can also be utilized with hard hats 10, 100, 200 and is substantially the same as accessory brackets 126, 226 except for the differences discussed herein.

Referring to FIG. 29, a rear perspective view of the accessory bracket 726 is shown according to an exemplary embodiment. A tab, shown as center tab 738 extends backwards (e.g., in direction of the mounting ridge) beyond (e.g., closer to mounting ridge of the hard hat) rear surface 756 of mounting bracket body 734. Center tab 738 includes a generally upward facing surface 760 that engages with the retention cleat of the hard hat when accessory bracket 726 is coupled to the hard. Rear surface 756 further includes a projection extending backwards, the projection including a recessed portion 765. The recessed portion 765 is configured to engage a retention cleat and further secure the accessory bracket 726 onto a hard hat (e.g., 10, 100, 200). Specifically, the retention cleat is received within a space or gap 762 between recessed portion 765 and upward facing surface 760 of center tab 738.

Figure 30:
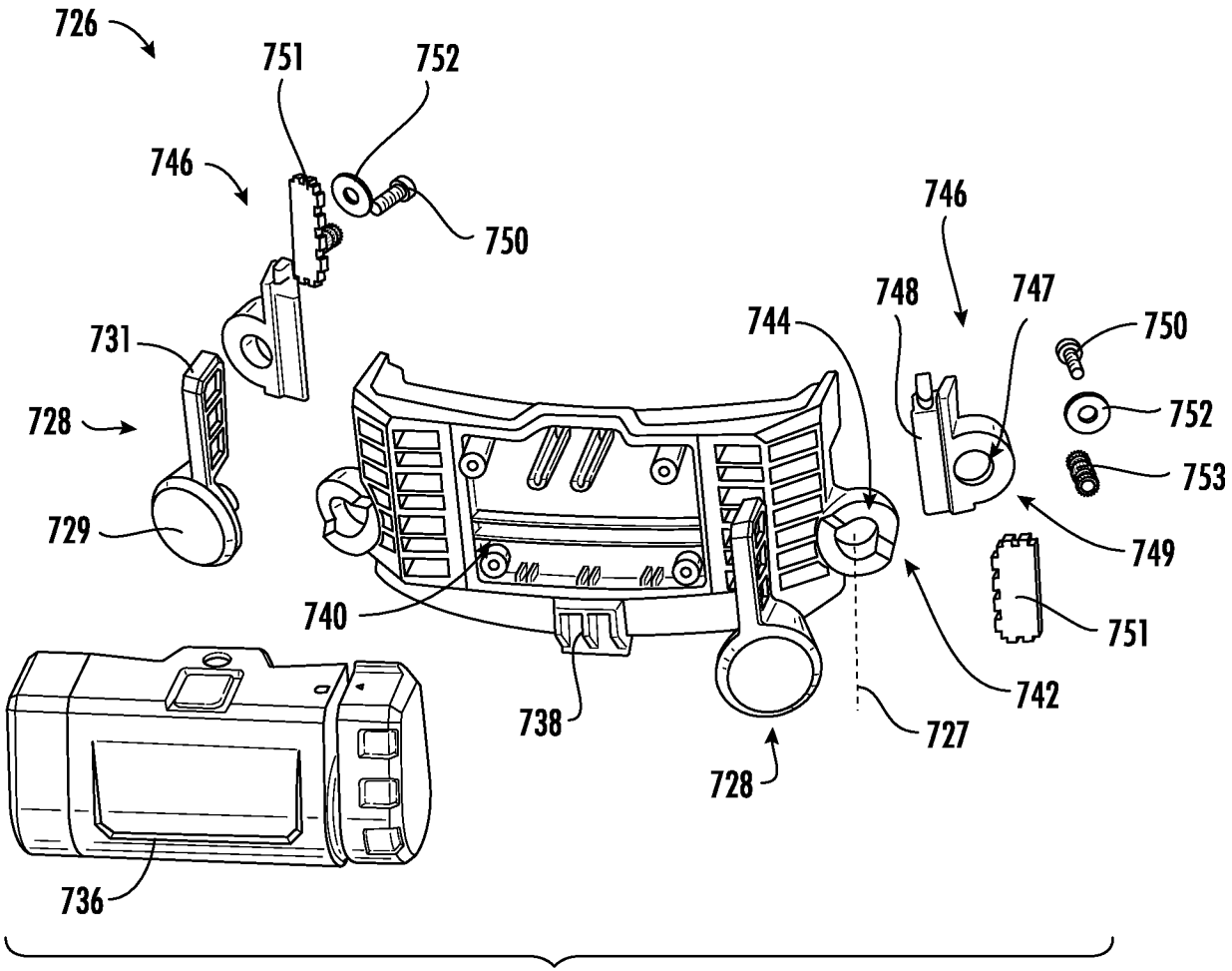
FIG. 30 is an exploded view of the accessory bracket of FIG. 27, according to an exemplary embodiment.

Referring to FIG. 30, an exploded view of the accessory bracket 726 is shown according to an exemplary embodiment. Accessory bracket 726 includes a pair of rear clamps 746. Each rear clamp 746 includes a clamping portion 748 and a clamp locking portion 749. A spacer 751 interfaces against clamping portion 748 and is coupled to rear surface 756.

Each clamp locking portion 749 includes a bore 747 extending through the locking portion 749 and positioned behind bore 744 of locking portion 742. A connector or fastener, shown as a screw 750 extends through bore 747 of clamp locking portion 749 and bore 744 of the mounting bracket body 734 when accessory bracket 726 is assembled. Each cam lever 728 is configured to receive a threaded connector 753 that coupled to and receives a portion of a screw 750. Screw 750 extends from within cam lever 728 and threaded connector 753 at least partially through locking portion 742 and rear clamp 746.

Figure 31:
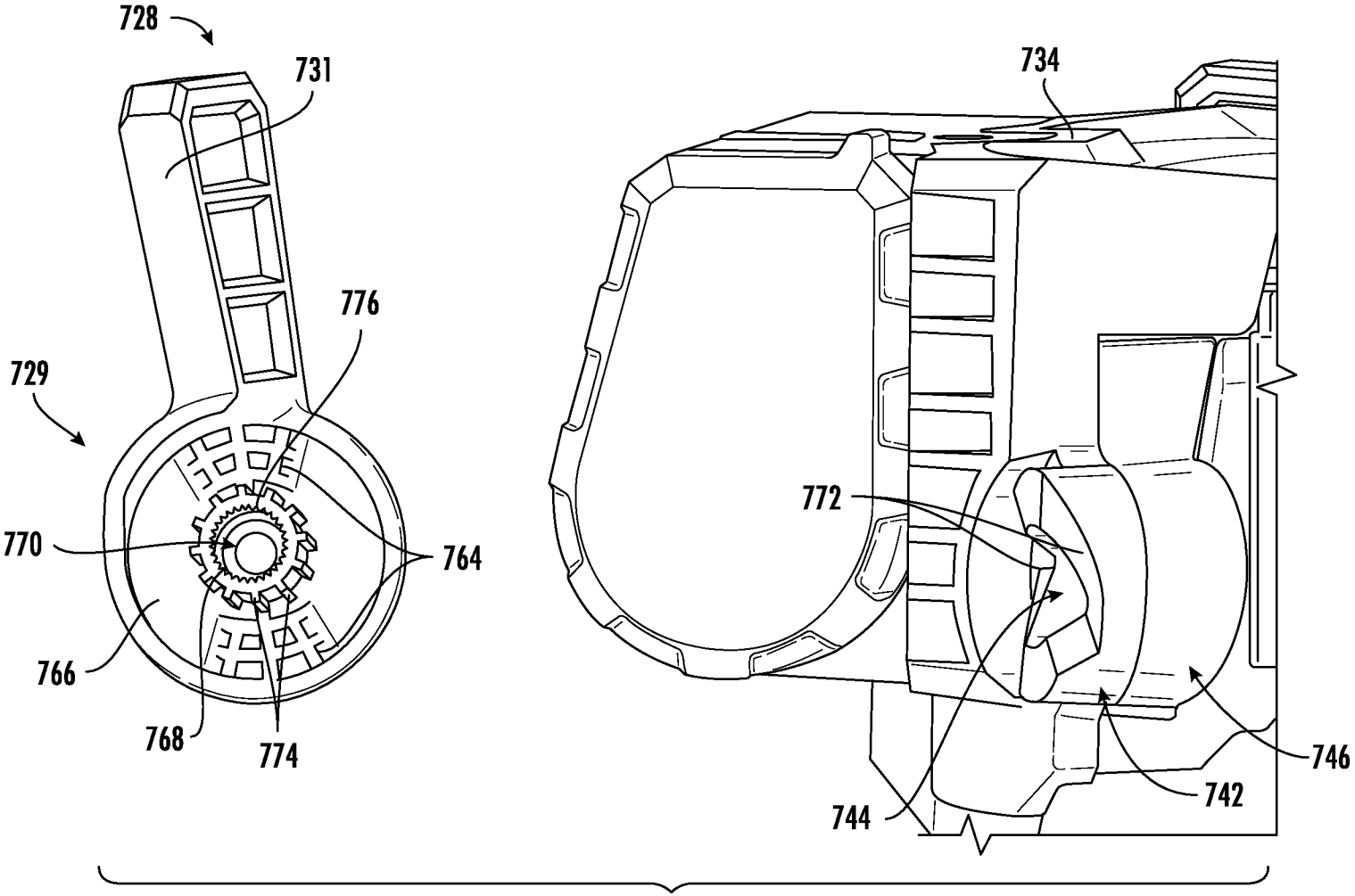
FIG. 31 is a partially exploded view of a locking portion of the accessory bracket of FIG. 27, according to an exemplary embodiment.
Figure 32:
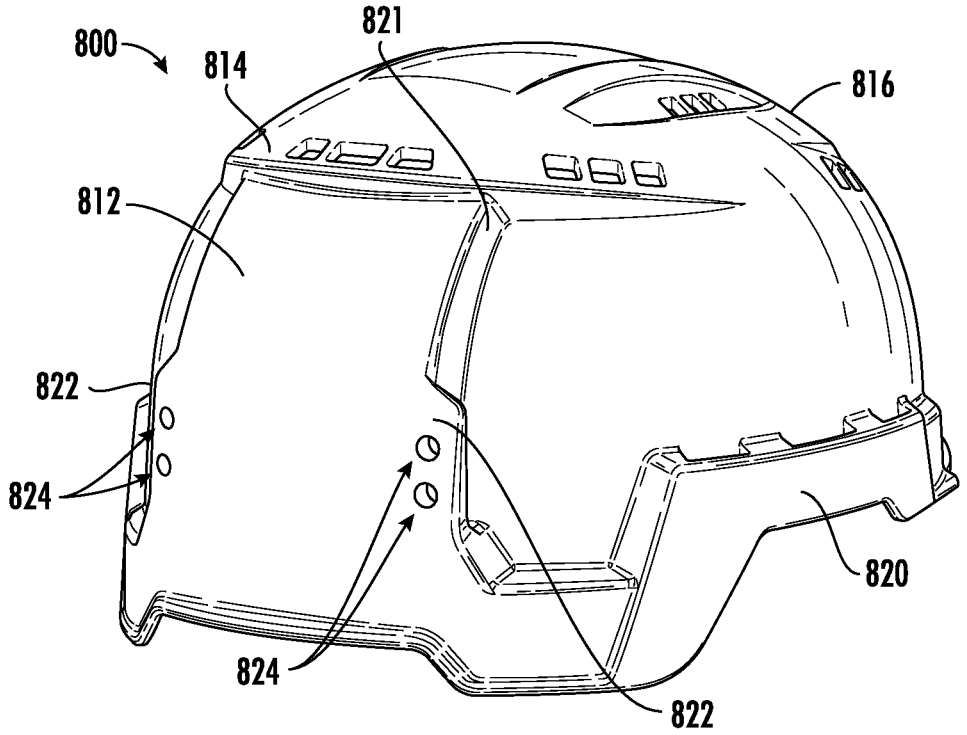
FIG. 32 is a rear perspective view of a hard hat, according to another exemplary embodiment.

Referring to FIG. 31, a partially exploded view of the locking portion 742 of accessory bracket 726 is shown according to an exemplary embodiment. Cam lever 728 and specifically body 729 includes an inward facing surface 766 (e.g., toward locking portion 742 and mounting bracket body 734). Two teeth 764 are coupled to inward facing surface 766 and extending toward locking portion 742 when accessory bracket 726 is assembled.

Inward facing surface 766 further includes a central projection 768 positioned between the two teeth 764. A bore 770 extends through at least a portion of central projection 768 along axis of rotation 727 when accessory bracket 726 is assembled. Central projection 768 includes a plurality of projections or splines 774 extending outward (i.e., away from bore 770). The inner surface of bore 770 includes a plurality of projections or splines 776 configured to engage with threaded connector 753. When assembled, central projection 768 is received within and coupled to mounting bracket body 734 and rear clamp 746 while bore 170 receives an end portion of threaded connector 753 and/or screw 750.

Figure 33:
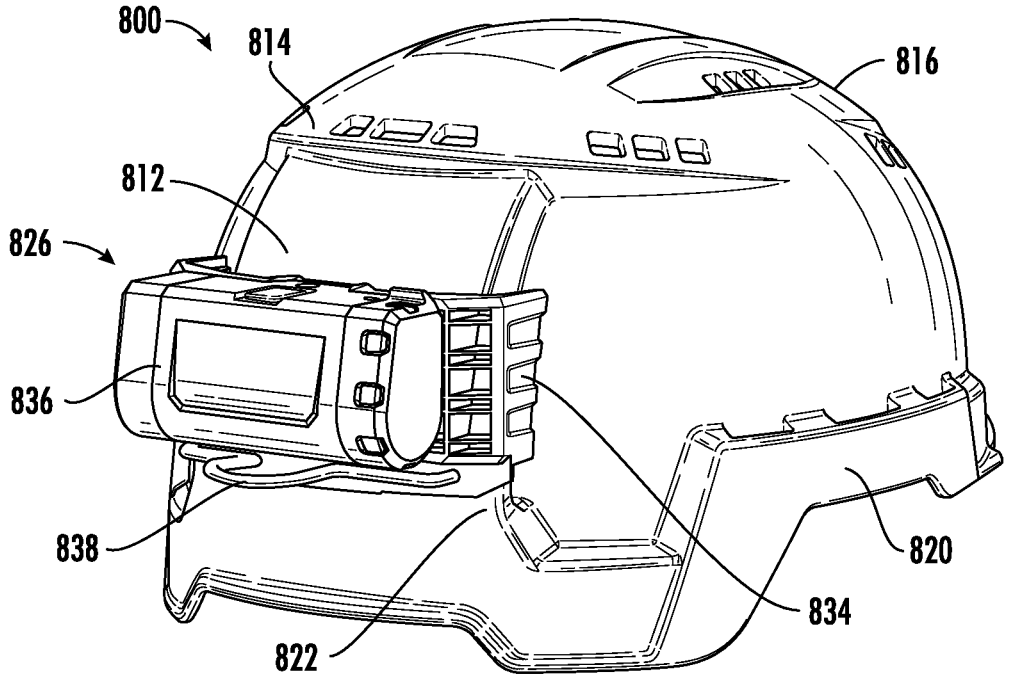
FIG. 33 is a perspective view of a hard hat of FIG. 32 connected to an accessory bracket at a rear mounting location of the hard hat, according to an exemplary embodiment.

Referring to FIG. 33, a rear mounting location of a hard hat 800 is shown according to an exemplary embodiment. Hard hat 800 includes a mounting ridge 812 on a rear side surface 814. Mounting ridge 812 includes a pair of dovetail projections or wings 822 extending outward from opposing planar surfaces 821 positioned on each side of mounting ridge 812. A plurality of bores, shown as mounting holes 824 are positioned on mounting ridge 812 and specifically on dovetail projections 822. In a specific embodiment, four mounting holes 824 are on mounting ridge 812 with two mounting holes 824 on each dovetail projection 822. In such an embodiment, one of the mounting holes 824 on a dovetail projection 822 is positioned above (i.e., closer ridge of hard hat) such that accessories can be stacked (i.e., positioned above and/or below) and still be secured to the hard hat 800.

Referring to FIG. 33, a rear perspective view of hard hat 800 coupled to an accessory bracket 826 is shown, according to an exemplary embodiment. Accessory bracket 826 is substantially the same as accessory brackets 126 and 226 except for the differences discussed herein. Battery pack 836 attaches vertically (i.e., downward along rear surface of hard hat 800) to accessory bracket 826. Similarly, accessory bracket 826 attaches vertically (i.e., downward along rear surface of hard hat 800) to hard hat 800 (see e.g., FIGS. 34-35). Accessory bracket 826 includes a release handle 838. In a specific embodiment, release handle 838 is a spring loaded release handle.

Figure 34:
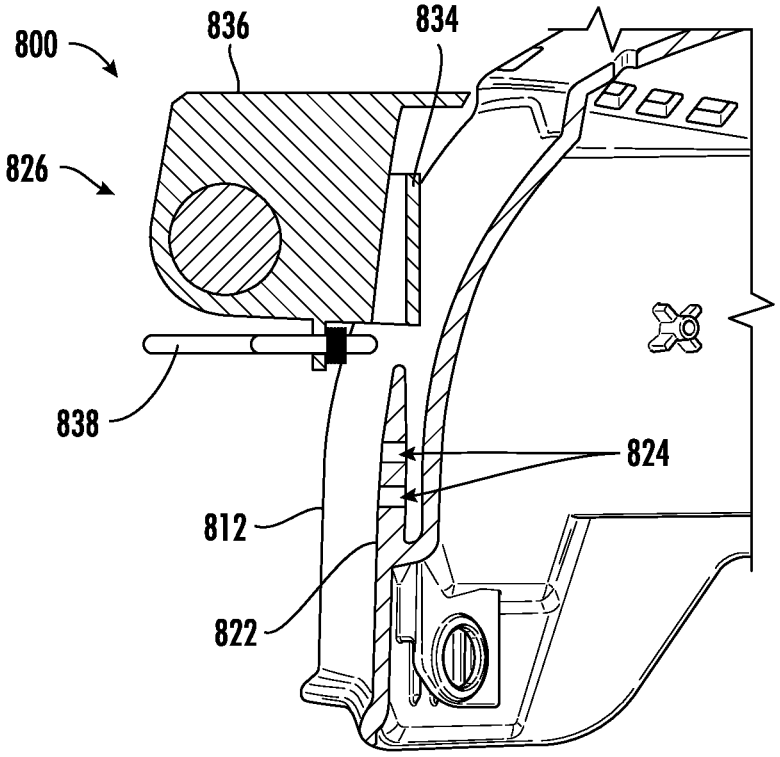
FIG. 34 is a cross-sectional view of the hard hat and accessory bracket of FIG. 33 in an unattached position, according to an exemplary embodiment.
Figure 35:
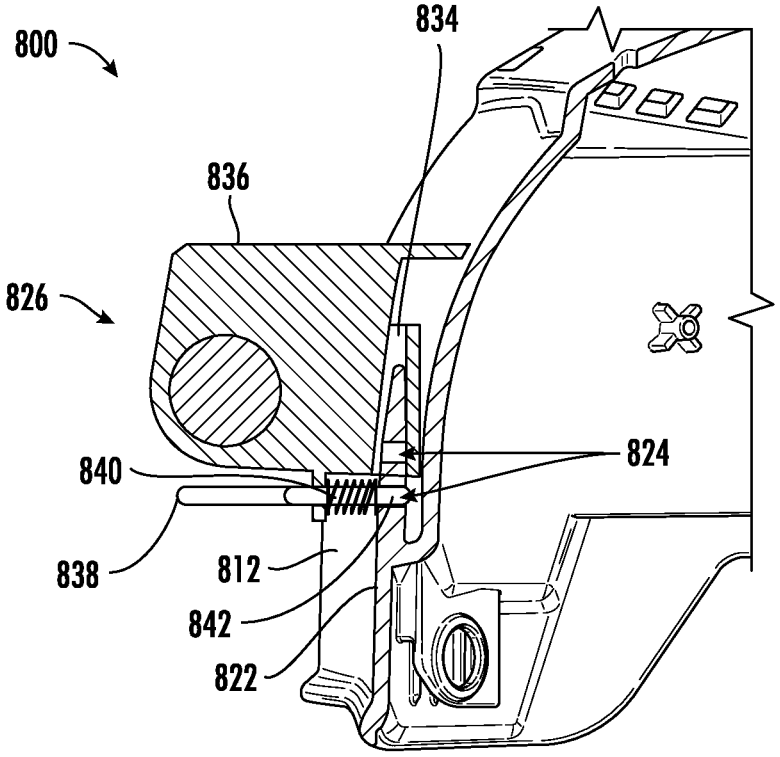
FIG. 35 is a cross-sectional view of the hard hat and accessory bracket of FIG. 33 in an attached position, according to an exemplary embodiment.

Referring to FIGS. 34-35, cross-sectional views of hard hat 800 and accessory bracket 826 in an attached (i.e., coupled position) and an unattached (i.e., uncoupled) position are shown, according to an exemplary embodiment. Release handle 838 includes a spring 840. When accessory bracket 826 is not attached to hard hat 800, release handle 838 can be retracted in a direction away from hard hat 800 (see e.g., position in FIG. 34). Once accessory bracket 826 has been lowered onto dovetail projections 822 of hard hat 800, release handle 838 can be released. When released handle 838 is released, an end 842 of release handle is received within one of the mounting holes 824 locking accessory bracket 826 onto hard hat 800.

Figure 36:
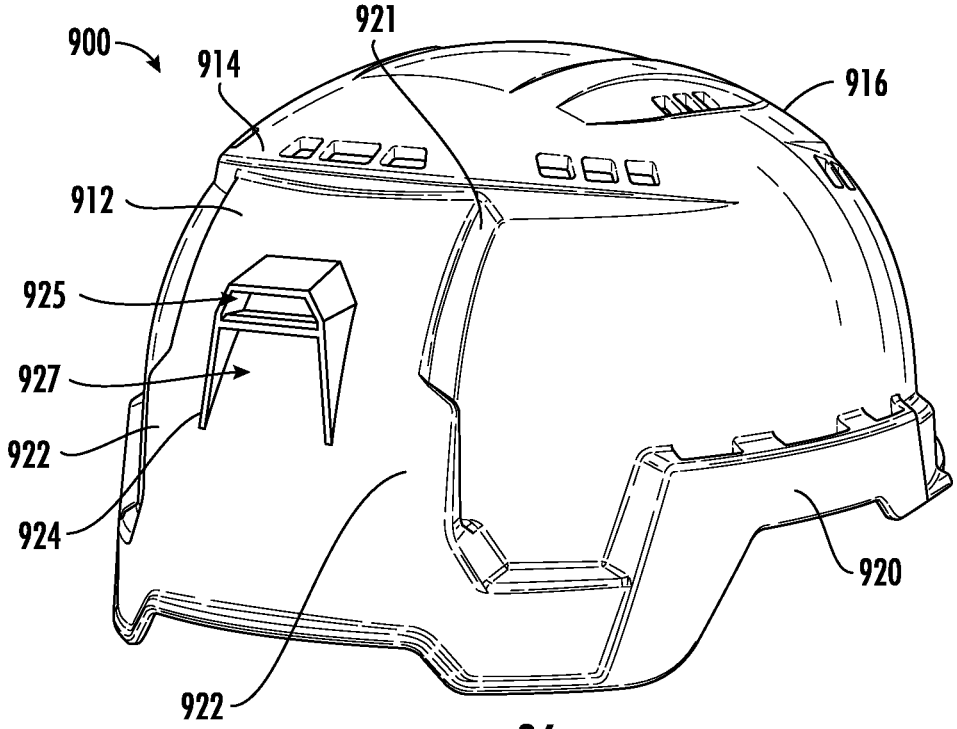
FIG. 36 is a rear perspective view of a hard hat, according to another exemplary embodiment.

Referring to FIG. 36, a rear mounting location of a hard hat 900 is shown according to an exemplary embodiment. Hard hat 900 includes a mounting ridge 912 on a rear side surface 914. Mounting ridge 912 includes a pair of dovetail projections or wings 922 extending outward from opposing planar surfaces 921 positioned on each side of mounting ridge 912. A retention structure 924 is coupled to mounting ridge 912. Retention structure 924 includes a first or upper retention pocket 925 and a second or lower retention pocket 927. Second retention pocket 927 is positioned below first retention pocket 925 or between upper retention pocket 925 and dovetail projections 922.

Figure 37:
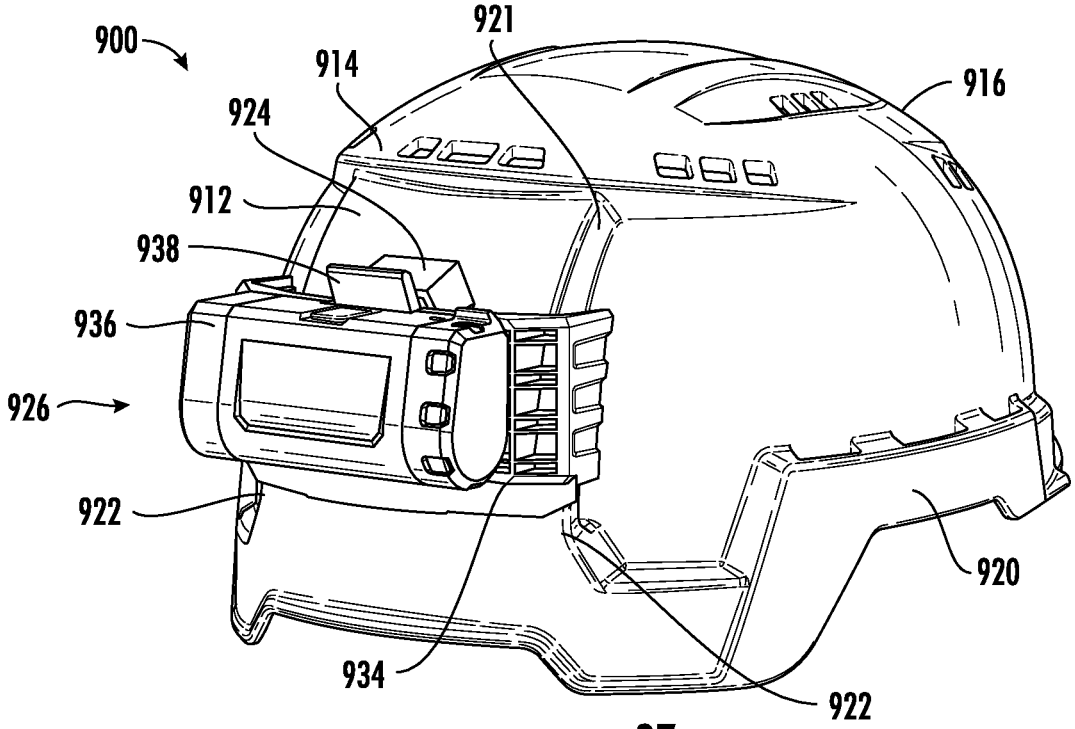
FIG. 37 is a perspective view of a hard hat of FIG. 36 connected to an accessory bracket at a rear mounting location of the hard hat, according to an exemplary embodiment.

Referring to FIG. 37, a rear perspective view of hard hat 900 coupled to an accessory bracket 926 is shown, according to an exemplary embodiment. Accessory bracket 926 is substantially the same as accessory brackets 126 and 226 except for the differences discussed herein. Accessory bracket 926 includes a spring finger with a release tab 938. Release tab 938 allows for coupling of accessory bracket 926 to hard hat 900 and specifically to retention structure 924. The spring finger allows release tab 938 to flex out (i.e., away from hard hat 900 and/or mounting ridge 912) and release accessory bracket 926 from a connection to hard hat 900. In a specific embodiment, the spring finger with the release tab 938 is formed from molded plastic.

Figure 38:
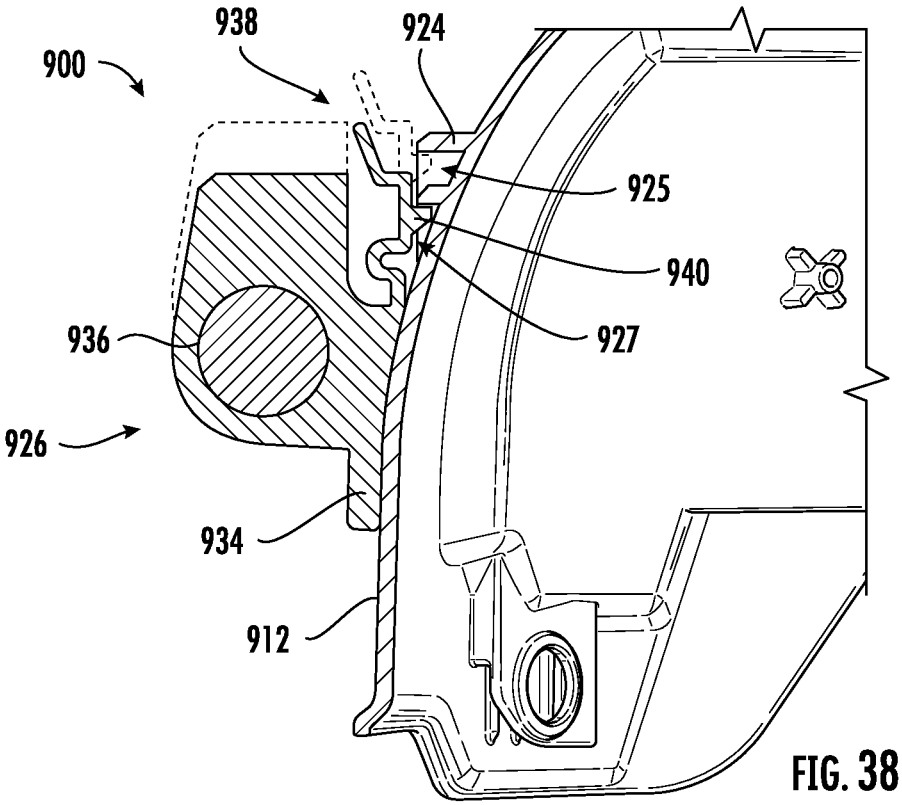
FIG. 38 is a cross-sectional view of the hard hat and accessory bracket of FIG. 37 in an attached position, according to an exemplary embodiment.
Figure 39:
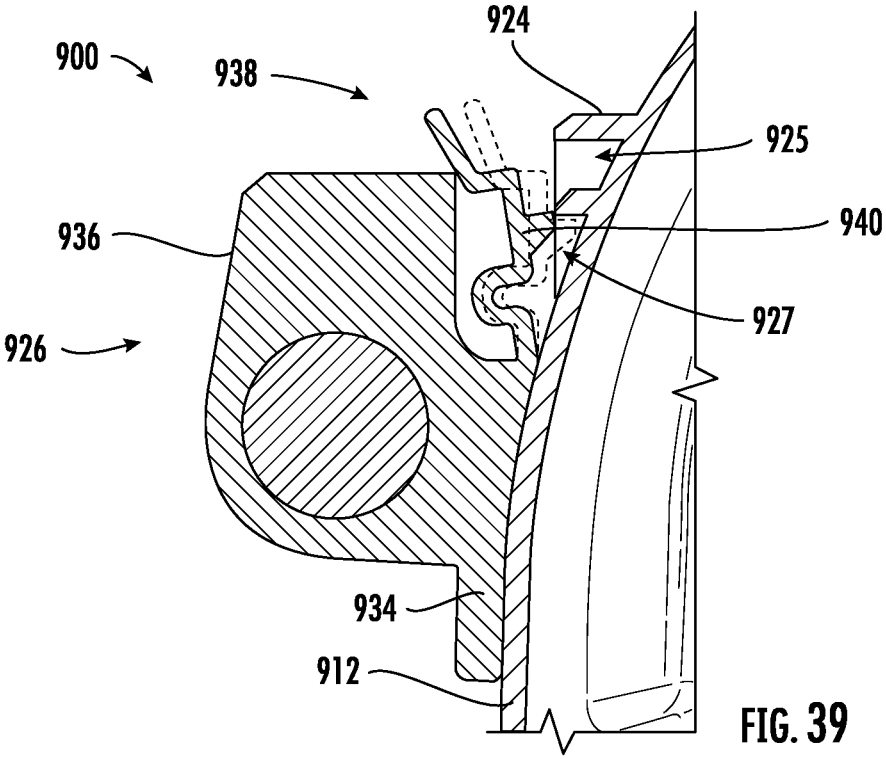
FIG. 39 is a cross-sectional view of the hard hat and accessory bracket of FIG. 37 in an unattached position, according to an exemplary embodiment.

Referring to FIGS. 38-39, cross-sectional views of hard hat 900 and accessory bracket 926 in an attached (i.e., coupled position) and an unattached (i.e., uncoupled) position are shown, according to an exemplary embodiment. When accessory bracket 926 is not attached to hard hat 900, release tab 938 is flexed in a direction away from hard hat 900 (see e.g., position in FIG. 39). Once accessory bracket 926 has been positioned to engage dovetail projections 922 of hard hat 900, release tab 938 can be released allowing a locking projection 940 to engage with and/or couple to retention structure 924. Locking projection 940 extends toward hard hat 900 (i.e., in a direction away from accessory bracket 926). Accessory bracket 926 can be coupled to either upper retention pocket 925 or lower retention pocket 927. When a user wants to attach more than one accessory to mounting ridge 912, accessory bracket 926 can be positioned to engage upper retention pocket 927 such that accessory bracket 926 is positioned above or resting on the other accessory.

In various embodiments, the accessory brackets and specifically the accessory bracket connectors discussed herein are configured to securely support a relatively heavy hard hat accessory from mounting locations on the hard hat. In various embodiments, the accessory brackets are configured to support accessories having a weight. Further, the accessory brackets are configured to maintain attachment of such heavy accessory to the hard hat even under forceful impacts. In contrast to typical accessory brackets, the heavy accessory (e.g., the battery pack) does not fall off the mounting location of the hard hat upon impact (e.g., upon dropping hard hat, falling object etc.).

It should be understood that the figures illustrate the exemplary embodiments in detail, and it should be understood that the present application is not limited to the details or methodology set forth in the description or illustrated in the figures. It should also be understood that the terminology is for description purposes only and should not be regarded as limiting.

Further modifications and alternative embodiments of various aspects of the disclosure will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one. As used herein, "rigidly coupled" refers to two components being coupled in a manner such that the components move together in a fixed positional relationship when acted upon by a force.

Various embodiments of the disclosure relate to any combination of any of the features, and any such combination of features may be claimed in this or future applications. Any of the features, elements or components of any of the exemplary embodiments discussed above may be utilized alone or in combination with any of the features, elements or components of any of the other embodiments discussed above.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A hard hat system, comprising:

a hard hat comprising a mounting ridge extending outward from a surface of the hard hat, the mounting ridge comprising:

opposing edges; and a retention cleat positioned between the opposing edges; and a mounting bracket that securely and removably couples the mounting bracket to the mounting ridge of the hard hat, the mounting bracket comprising:

a first end;

a second end opposite the first end;

a first slot located at the first end, the first slot receiving and enclosing one of the opposing edges of the mounting ridge;

a second slot located at the second end, the second slot receiving and enclosing the other of the opposing edges of the mounting ridge;

a tab positioned between the first end and the second end and configured to engage to the retention cleat of the hard hat;

a first lever coupled to the first end; and a second lever coupled to the second end;

wherein, when the first lever and second lever are rotated, the mounting bracket clamps onto the opposing edges of the mounting ridge to couple the mounting bracket to the mounting ridge.

2. The hard hat system of claim 1, the tab further comprising a recess facing the mounting ridge, the recess sized to receive the retention cleat and further secure the mounting bracket onto the hard hat.

3. The hard hat system of claim 1, wherein the first lever and second lever each include a body portion and a lever portion extending away from the body portion along a longitudinal axis of the first and second levers.

4. The hard hat system of claim 3, the mounting bracket further comprising opposing end projections positioned at the first end and the second end, and wherein, when the first and second levers are in a locked position, each lever portion extends along the opposing end projections.

5. The hard hat system of claim 3, the mounting ridge further comprising opposing planar surfaces positioned on each side of mounting ridge, and wherein, when the first and second levers are in an unlocked position, each lever portion extends in a direction away from the opposing planar surfaces.

6. The hard hat system of claim 3, wherein the first lever is rotatable about a first axis of rotation and the second lever is rotatable about a second axis of rotation, and wherein the first and second axes of rotation extend outward and forward from the mounting ridge.

7. The hard hat system of claim 1, wherein an accessory is coupled to the mounting bracket.

8. The hard hat system of claim 7, wherein the accessory is a battery pack.

9. A mounting bracket configured to couple to a hard hat comprising a mounting ridge, the mounting bracket comprising:

a first end;

a second end opposite the first end;

a first receiving slot that receives the mounting ridge and removably couples the mounting bracket to the hard hat;

a second receiving slot that receives the mounting ridge and removably couples the mounting bracket to the hard hat;

a first rear clamp that at least partially defines the first receiving slot;

a second rear clamp that at least partially defines the second receiving slot;

a first cam lever positioned at the first end and rotatably coupled to the mounting bracket; and a second cam lever positioned at the second end and rotatably coupled to the mounting bracket;

wherein, when a user actuates the first and second cam levers in a first direction, the first and second rear clamps are pulled toward the mounting bracket such that the mounting bracket compresses a portion of the mounting ridge, and wherein, when the user actuates the first and second cam levers in a second direction, the first and second rear clamps are moved away from the mounting bracket such that the mounting bracket releases the portion of the mounting ridge.

10. The mounting bracket of claim 9, further comprising a tab positioned between the first end and the second end and of the mounting bracket, the tab including a recess configured to engage a detent positioned on the hard hat mounting ridge.

11. The mounting bracket of claim 10, the tab extending downward from the mounting bracket toward a brim of the hard hat, the brim extending outward from a lower circumference of hard hat.

12. The mounting bracket of claim 9, wherein the first lever is rotatable about a first axis of rotation and the second lever is rotatable about a second axis of rotation, and wherein the first and second axes of rotation extend in a perpendicular orientation to the first and second receiving slots.

13. The mounting bracket of claim 9, wherein the portion of the mounting ridge is a pair of dovetail projections extending into the first and second receiving slots.

14. The mounting bracket of claim 9, wherein the mounting bracket includes a connection portion, the connection portion extending between the first and second cam levers.

15. The mounting bracket of claim 14, wherein a battery pack is coupled to the connection portion of the mounting bracket.

16. A hard hat accessory system, comprising:

a hard hat comprising:

a front mounting ridge on a front side surface;

a rear mounting ridge on a rear side surface; and a detent positioned on at least one of the front mounting ridge and rear mounting ridge;

a mounting bracket that securely and removably mounts to either the front mounting ridge or the rear mounting ridge of the hard hat, the mounting bracket comprising:

rear clamps;

slots defining a distance between a rear surface of the mounting bracket and an inner surface of the rear clamps, the slots receive the mounting ridge and removably couple the mounting bracket to one of the front side surface or the rear side surface of the hard hat;

cam levers rotatably coupled to the mounting bracket; and a tab positioned between the cam levers and configured to engage to the detent of the hard hat;

wherein, when the cam levers are actuated, the distance between the rear surface of the mounting bracket and the inner surface of the rear clamps is changed.

17. The hard hat accessory system of claim 16, wherein a distance between the rear surface of the mounting bracket and the inner surface of the rear clamps when the cam levers are in a locked position is less than a distance between the rear surface of the mounting bracket and the inner surface of the rear clamps when the cam levers are in an unlocked position.

18. The hard hat accessory system of claim 16, wherein the cam levers each include a body portion and a lever portion extending away from the body portion along a longitudinal axis of the cam levers.

19. The hard hat accessory system of claim 18, wherein an axis of rotation of each cam lever extends through the body portion of the cam lever.

20. The hard hat accessory system of claim 16, further comprising a rigid mounting bracket that securely and removably mounts to either the front mounting ridge or the rear mounting ridge of the hard hat.

* * * * *